US011970824B2

(12) United States Patent
Ogorchock et al.

(10) Patent No.: US 11,970,824 B2
(45) Date of Patent: Apr. 30, 2024

(54) BRIDGE APPARATUS, SYSTEMS AND METHODS OF CONSTRUCTION

(71) Applicant: SUMMIT PRECAST CONCRETE LP, Montgomery, TX (US)

(72) Inventors: John Michael Ogorchock, Montgomery, TX (US); Michael Ryan Ogorchock, Montgomery, TX (US)

(73) Assignee: SUMMIT PRECAST CONCRETE LP, Montgomery, TX (US)

( * ) Notice: Subject to any disclaimer, the term of this patent is extended or adjusted under 35 U.S.C. 154(b) by 0 days.

(21) Appl. No.: 18/353,542

(22) Filed: Jul. 17, 2023

(65) Prior Publication Data

US 2023/0366159 A1 Nov. 16, 2023

Related U.S. Application Data

(62) Division of application No. 17/930,659, filed on Sep. 8, 2022, now Pat. No. 11,718,964.

(Continued)

(51) Int. Cl.
*E01D 19/12* (2006.01)
*E01D 2/02* (2006.01)

(Continued)

(52) U.S. Cl.
CPC ..... *E01D 19/125* (2013.01); *E01D 2/02* (2013.01); *E01D 19/02* (2013.01); *E01D 21/00* (2013.01); *E01D 2101/28* (2013.01)

(58) Field of Classification Search
CPC ..... E01D 19/125; E01D 19/02; E01D 2/02; E01D 21/00; E01D 2101/28
See application file for complete search history.

(56) References Cited

U.S. PATENT DOCUMENTS 3,999,394 A 12/1976 Eberhardt et al.
4,343,123 A * 8/1982 Soerjohadikusumo ... E04B 5/29 29/446

(Continued)

FOREIGN PATENT DOCUMENTS

EP 1336688 A1 8/2003

OTHER PUBLICATIONS

JVI, "Vector Connector", pp. 1-2, 2017, published by JVI Inc., Lincolnshire, Illinois (USA).

(Continued)

*Primary Examiner* — Abigail A Risic
(74) *Attorney, Agent, or Firm* — Jeffrey L. Wendt; The Wendt Firm, P.C.

(57) ABSTRACT

Bridge systems and methods for constructing bridges having overhang surfaces employing generally rectangular, precast, prestressed concrete panels. One method includes delivering a plurality of generally rectangular, precast, prestressed concrete panels to an installation site, and delivering one or more support beams to the installation site, each support beam having a support and a base. The concrete panels are positioned on the supports of the one or more support beams with an overhang panel section and a traffic panel section. The concrete panels are then connected to the support beams by positioning steel reinforcement in block outs or voids, pouring unsolidified concrete into the voids, and curing the unsolidified concrete to form an overhang traffic surface. Bridges constructed employing the precast, prestressed concrete panels and methods. Other bridge systems employ prestressed concrete L-walls and double-T members, where weight-bearing L-walls have pockets for webs of the double-T members.

13 Claims, 17 Drawing Sheets

Related U.S. Application Data

(60) Provisional application No. 63/281,969, filed on Nov. 22, 2021, provisional application No. 63/243,273, filed on Sep. 13, 2021.

(51) Int. Cl.

| | |
|---|---|
| ***E01D 19/02*** | (2006.01) |
| ***E01D 21/00*** | (2006.01) |
| *E01D 101/28* | (2006.01) |

(56) References Cited

U.S. PATENT DOCUMENTS

| | | | | |
|---|---|---|---|---|
| 4,494,892 | A | | 1/1985 | Wojciechowski |
| 4,604,841 | A | | 8/1986 | Barnoff |
| 4,710,994 | A | | 12/1987 | Kishida |
| 4,977,636 | A | * | 12/1990 | King ..... E01D 19/02 52/251 |
| 5,471,811 | A | | 12/1995 | House et al. |
| 5,617,599 | A | * | 4/1997 | Smith ..... E01D 19/125 14/77.1 |
| 5,802,652 | A | | 9/1998 | Smith |
| 5,826,290 | A | | 10/1998 | Kokonis |
| 5,978,997 | A | | 11/1999 | Grossman |
| 6,185,897 | B1 | | 2/2001 | Johnson et al. |
| 6,449,914 | B1 | | 9/2002 | Horstketter |
| 6,568,139 | B2 | | 5/2003 | Bot |
| 6,574,818 | B1 | | 6/2003 | Matiere |
| 8,285,411 | B2 | | 10/2012 | Hull et al. |
| 9,212,521 | B2 | | 12/2015 | McCarty et al. |
| 10,895,047 | B2 | | 1/2021 | Nelson |
| 11,155,988 | B1 | | 10/2021 | Ogorchock et al. |
| 11,718,964 | B2 | | 8/2023 | Ogorchock et al. |
| 2004/0099750 | A1 | | 5/2004 | Reichel et al. |
| 2005/0144890 | A1 | | 7/2005 | Kim |
| 2007/0272353 | A1 | | 11/2007 | Wheatley |
| 2010/0319271 | A1 | | 12/2010 | Sarraf |
| 2011/0110717 | A1 | | 5/2011 | Eisenhardt |
| 2013/0263392 | A1 | | 10/2013 | Han |
| 2018/0135261 | A1 | | 5/2018 | Nelson |
| 2018/0291570 | A1 | | 10/2018 | Lee |
| 2020/0157817 | A1 | | 5/2020 | Nishino |
| 2021/0025120 | A1 | | 1/2021 | Vanaman |
| 2021/0131048 | A1 | | 5/2021 | Allen |
| 2021/0363711 | A1 | | 11/2021 | He |
| 2022/0205240 | A1 | | 6/2022 | Stretch |

OTHER PUBLICATIONS

JVI, "Platinum J-Finish Specifications", pp. 1-4, 2016, published by JVI Inc., Lincolnshire, Illinois (USA).

Paradigm, "Precast Concrete Structures", pp. 1-21, 2011, published by Paradigm (India).

Jinding Reinforcing Steel Bar Manufacturing Co., "Reinforcing Steel PC Strand", p. 1, published by Jinding (China), downloaded from the Internet Sep. 7, 2022, at url: https://reinforcingsteelbar.com/reinforcingbar/reinforcing-steel-pc-strand.html.

Meadow Burke, "RL-3 Tech Erection Anchor", pp. 1-2, published by Meadow Burke, Riverview, Florida (USA), downloaded from the Internet Aug. 24, 2022, at url: https://meadowburke.com/product/rl-3-tech-erection-anchor/.

United States Patent & Trademark Office, Office Action for U.S. Appl. No. 17/930,659, mailed Jan. 31, 2023; 15 pages.

Ogorchock et al., Amendment and Response for U.S. Appl. No. 17/930,659, filed May 1, 2023; 5 pages.

Notice of Allowance and Fee Due with Notice of Allowability for U.S. Appl. No. 17/930,659 mailed Jun. 1, 2023; 17 pages.

* cited by examiner

400

402 A method of installing a bridge system, the method comprising:

404 a) delivering a plurality of generally rectangular, precast, prestressed concrete panels to an installation site, each of the generally rectangular, precast, prestressed concrete panels having:

I) a length L, a width W, a thickness t, a top surface, a bottom surface, a leading edge, a trailing edge, an inner edge, and an overhang edge;

ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

iii) the generally planar panel upper portion having same width W as the generally planar bottom panel portion, and having a length 1 that is less than the length L, while the generally planar bottom panel portion has a length L;

iv) a concave cutout formed in the inner edge, the leading edge, and the trailing edge; and v) at least one block out or void for placing wire mesh cages for closure pour of concrete to connect the generally rectangular, precast, prestressed concrete panel to a support;

406 b) delivering one or more support beams to the installation site, each support beam having a support and a base;

408 c) positioning the plurality of generally rectangular, precast, prestressed concrete panels on the supports of the one or more support beams with an overhang panel section and a traffic panel section;

410 d) optionally backfilling over the bases of the at least one support beams; and 412 e) connecting the generally rectangular, precast, prestressed concrete panels to the support beams by positioning wire mesh cages in the at least one block out or void, pouring unsolidified concrete into the at least one block out or void, and curing the unsolidified concrete to form an overhang traffic surface.

FIG. 11

BRIDGE APPARATUS, SYSTEMS AND METHODS OF CONSTRUCTION

CROSS-REFERENCE TO RELATED APPLICATIONS

This application is a division of nonprovisional application Ser. No. 17/930,659, filed Sep. 8, 2022, and is entitled to and claims the benefit of provisional application No. 63/243,273, filed Sep. 13, 2021, and provisional application No. 63/281,969, filed Nov. 22, 2021 under 35 U.S.C. § 119(e), which nonprovisional and provisional applications are incorporated by reference herein in their entireties. This application may also be related to applicant's U.S. Pat. No. 11,155,988, issued Oct. 26, 2021.

BACKGROUND INFORMATION

Technical Field

The present disclosure relates generally to bridge apparatus, bridge systems, and methods for constructing bridges, and more particularly to apparatus, systems, and methods of using prestressed, precast concrete panels to place on highway bridge beams to create an overhang traffic surface, and to prestressed, precast concrete structures that may be transported (for example, on a flatbed truck) partially or fully assembled to the site where a new or replacement bridge is needed, such as smaller "county" bridges over small water streams.

Background Art

Current systems and methods to construct concrete panels to place on highway bridge beams to create an overhang traffic surface involve placing hardware and forms to cast the elements in place on site. This activity is slow, time consuming and requires workers to perform these tasks while wearing fall protection equipment and hand forming these elements in the air up to 100 feet plus above the ground. It is slow tedious and dangerous work. Smaller bridges over small water streams, which are referred to herein as "county" bridges, while not typically being as high and dangerous, still involve placing hardware and forms to cast the elements in place on site, typically requiring several loads of uncured cement precursors carried by large, heavy cement trucks, and/or transporting several precast structures to the site which are then assembled to form the county bridge.

While there have been efforts to construct roadways using precast concrete panels, such as discussed in United States Pub. Patent App. No. 2011/0110717, to our knowledge such precast concrete panel systems have not achieved commercial success or acceptance by authorities tasked with approving and building such roadways, and to our knowledge have never been used in constructing bridges, much less bridges having an overhang traffic surface. The '717 publication does not disclose or discuss overhangs. Finally, the precast concrete panels described in the '717 publication are devoid of block outs or voids for placing wire mesh cages for closure pours of concrete to connect the panels to the supports, providing an inherently weak structure.

As may be seen, there remains a need for apparatus, systems, and methods with more advanced, robust, and flexible solutions while reducing cost and increasing safety. Presently available methods and systems may not be adequate for all circumstances, may lead to higher costs and worker injuries, and at worst may result in injury or death to construction personnel, inspectors, or to other personnel or the public during construction of overhang traffic surface systems. There remains a need for safer, less expensive, less labor-intensive, more robust overhang traffic surface systems and methods. As for the smaller county bridges, it would be of great benefit to the public if precast county bridges could be transported directly to the site where needed and installed while avoiding the need to place hardware and forms to cast the elements in place on site, typically requiring several loads of uncured cement precursors carried by large, heavy cement trucks. The systems and methods of the present disclosure are directed to these needs.

SUMMARY

In accordance with the present disclosure, bridge apparatus, systems and methods of construction of bridges using the bridge apparatus and systems are described which reduce or overcome many of the faults of previously known systems and methods.

A first aspect of the disclosure are apparatus, certain embodiments comprising:

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

c) the generally planar panel upper portion having same width W as the generally planar bottom panel portion, and having a length l that is less than the length L, while the generally planar bottom panel portion has a length L;

d) a concave cutout formed in the inner edge, the leading edge, and the trailing edge; and e) the generally rectangular, precast, prestressed concrete panel having at least one block out or void for placing wire mesh cages for closure pour of concrete to connect the generally rectangular, precast, prestressed concrete panel to a support.

Certain apparatus embodiments may comprise a traffic panel section extending from the leading edge to the trailing edge, and from the inner edge to a line parallel with the inner edge, and an overhang panel section, the overhang section extending from the line parallel with the inner edge to the overhang edge. Certain apparatus embodiments may comprise wherein the traffic panel section is a major portion of the generally rectangular, precast, prestressed concrete panel. Certain apparatus embodiments may comprise wherein the at least one block out or void has a plan shape selected from octagonal, pentagonal, hexagonal, rectangular, round, elliptical, triangular, and trapezoidal. Certain apparatus embodiments may comprise wherein the at least one block out or void has an upper void length, an upper void width, a bottom void length, and a bottom void width, and wherein the upper void length is greater than the bottom void length, and wherein the upper void width is greater than the bottom void width. Certain apparatus embodiments may comprise wherein the line parallel with the inner edge bisects the at least one block out or void for placing wire mesh cages for closure pour of concrete. Certain apparatus embodiments may comprise at least one anchor to bolt steel plate forms to the overhang edge of the generally rectangular, precast, prestressed concrete panel. Certain apparatus embodiments may comprise an angle α equal to a radius angle of a horizontal roadway, wherein angle α ranges from about 1 to about 10 degrees, or from about 1 to about 5 degrees.

A second aspect of the disclosure are bridge systems, certain systems comprising:

a) a plurality of generally rectangular, precast, prestressed concrete panels, each of the generally rectangular, precast, prestressed concrete panels comprising:
   i) a length L, a width W, a thickness t, a top surface, a bottom surface, a leading edge, a trailing edge, an inner edge, and an overhang edge;
   ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;
   iii) the generally planar panel upper portion having same width W as the generally planar bottom panel portion, and having a length l that is less than the length L, while the generally planar bottom panel portion has a length L;
   iv) a concave cutout formed in the inner edge, the leading edge, and the trailing edge; and
   v) at least one block out or void for placing wire mesh cages for closure pour of concrete to connect the generally rectangular, precast, prestressed concrete panel to a support; and b) at least one support beam attached to the plurality of generally rectangular, precast, prestressed concrete panels by a combination of wire and poured, solidified concrete.

Certain system embodiments may comprise wherein one of the at least one support beams is attached through the at least one block out or void by the combination of wire and poured, solidified concrete. Certain system embodiments may comprise wherein the at least one support beam is a prestressed concrete girder. Certain system embodiments may comprise wherein the prestressed concrete girder comprises one or more vertical U-shaped steel wire reinforcements having a U-portion and two leg portions, wherein the U-portion extends into the poured, solidified concrete. Certain system embodiments may comprise wherein each of the generally rectangular, precast, prestressed concrete panels comprises a traffic panel section extending from the leading edge to the trailing edge, and from the inner edge to a line parallel with the inner edge, and an overhang panel section, the overhang section extending from the line parallel with the inner edge to the overhang edge. Certain system embodiments may comprise wherein the traffic panel section is a major portion of the generally rectangular, precast, prestressed concrete panels. Certain system embodiments may comprise wherein the at least one block out or void has a plan shape selected from octagonal, pentagonal, hexagonal, rectangular, round, elliptical, triangular, and trapezoidal. Certain system embodiments may comprise wherein the line parallel with the inner edge bisects the at least one block out or void for placing wire mesh cages for closure pour of concrete. Certain system embodiments may comprise an angle α equal to a radius angle of a horizontal roadway, wherein angle α ranges from about 1 to about 10 degrees.

A third aspect of the disclosure are methods of installing a bridge system of the present disclosure, certain methods comprising:

a) delivering a plurality of generally rectangular, precast, prestressed concrete panels to an installation site, each of the generally rectangular, precast, prestressed concrete panels having:
   i) a length L, a width W, a thickness t, a top surface, a bottom surface, a leading edge, a trailing edge, an inner edge, and an overhang edge;
   ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;
   iii) the generally planar panel upper portion having same width W as the generally planar bottom panel portion, and having a length l that is less than the length L, while the generally planar bottom panel portion has a length L;
   iv) a concave cutout formed in the inner edge, the leading edge, and the trailing edge; and
   v) at least one block out or void for placing wire mesh cages for closure pour of concrete to connect the generally rectangular, precast, prestressed concrete panel to a support;

b) delivering one or more support beams to the installation site, each support beam having a support and a base;

c) positioning the plurality of generally rectangular, precast, prestressed concrete panels on the supports of the one or more support beams with an overhang panel section and a traffic panel section;

d) optionally backfilling over the bases of the at least one support beams; and e) connecting the generally rectangular, precast, prestressed concrete panels to the support beams by positioning steel reinforcement (for example, but not limited to wire mesh cages) in the at least one block out or void, pouring unsolidified concrete into the at least one block out or void, and curing the unsolidified concrete to form an overhang traffic surface.

In certain methods of this disclosure the methods may comprise:

wherein the delivering a plurality of generally rectangular, precast, prestressed concrete panels to an installation site comprises delivering a left side plurality of generally rectangular, precast, prestressed concrete panels and a right side plurality of generally rectangular, precast, prestressed concrete panels to an installation site;

wherein the delivering of one or more support beams to the installation site comprises delivering a left outside prestressed concrete girder support and a right outside prestressed concrete girder support and one inside prestressed concrete girder support to the installation site;

positioning inside edges of the left and right side pluralities of generally rectangular, precast, prestressed concrete panels on the inside prestressed concrete girder support such that there is formed a gap between the inside edges;

positioning overhang edges of the left and right side pluralities of generally rectangular, precast, prestressed concrete panels on the left outside and right outside prestressed concrete girder supports, respectively, so as to provide a left overhang section and a right overhang section;

connecting the left and right pluralities of generally rectangular, precast, prestressed concrete panels to the inside prestressed concrete girder support by positioning steel wire reinforcing cages in the gaps, pouring unsolidified concrete into the gaps, and curing the unsolidified concrete; and connecting the left and right pluralities of generally rectangular, precast, prestressed concrete panels to the left and right prestressed concrete girder supports by positioning steel wire reinforcing cages in the at least one block out or void in each of the left and right pluralities of generally rectangular, precast, prestressed concrete panels, pouring unsolidified concrete into the at least one block out or void, and curing the unsolidified concrete.

Certain methods may comprise casting prestressed concrete panels in a manufacturing facility under a controlled environment; transporting the cast prestressed concrete panels to a proposed bridge location; and installing the cast prestressed concrete panels on pre-installed bridge beams, the pre-installed bridge beams installed generally parallel to a traffic direction, forming a traffic surface having left-side and right-side cast prestressed concrete panel overhangs.

In other embodiments, one or more bridging plates may be precast into the precast panels, the bridging plates further secured in the precast panels with two or more studs positioned on both sides of the bridging plates at substantially 90-degree angles to the bridging plates by welding headed studs to the bridging plates. The angles need not be 90 degrees but may vary by plus-25 degrees or minus-25 degrees from perpendicular; not all studs need be 90 degrees, and not all studs need form the same angle with the bridging plates. Holes or slots are provided in the bridging plates to accommodate transverse bars cast into the precast panels. Longitudinal bars are also cast into the precast traffic panels. A truss wire assists securing precast overhang panels to the precast traffic panels. To complete the construction on-site, cast-in-place (CIP) concrete is poured over the precast traffic panels and precast overhang panels, as well as filling gaps between ends of the precast traffic panels and the precast overhang panels. Transverse bars and longitudinal bars may be provided in the CIP concrete. In certain embodiments, prestressed wire strands and bridging plates remove the need for wide, thin bottom edges for a cast in place closure pour to connect the panels.

Yet another aspect of this disclosure are bridge systems, certain embodiments comprising:

a) one or more load-bearing, regular precast pocketed L-walls, each having a stem, a forebase, and a hindbase, with two pockets in the stem in a hindbase side of the stem;

b) a load-bearing, right-sided irregular precast pocketed L-wall, each having a stem, a forebase, and a hindbase, with two pockets in the stem in a hindbase side of the stem;

c) a non-load-bearing, right-sided irregular precast non-pocketed L-wall;

d) a non-load-bearing, left-sided irregular precast L-wall;

e) load-bearing, left-sided irregular precast L-wall, each having a stem, a forebase, and a hindbase, with two pockets in the stem in a hindbase side of the stem;

f) a plurality of double-T members arranged and fastened together in at least two adjacent rows, with an equal number of double-T members in each row, each double-T member having a pair of webs, a span, and two flanges, and forming a plurality of webs, each of the plurality of webs having a proximal end and a distal end resting in one of the pockets;

g) the one or more load-bearing, regular precast pocketed L-walls being proximate a middle of the bridge system;

h) the load-bearing right-sided irregular precast pocketed L-wall having one edge positioned adjacent and fastened to a mating edge of the non-load-bearing left-sided irregular precast L-wall;

i) the non-load-bearing right-sided irregular precast L-wall having one edge positioned adjacent and fastened to a mating edge of the load-bearing left-sided irregular precast pocketed L-wall; and j) the one or more load-bearing regular precast pocketed L-walls forming first and second edges, the first edge positioned adjacent and fastened to a mating edge of the load-bearing left-sided irregular precast pocketed L-wall, and the second edge positioned adjacent and fastened to a mating edge of the load-bearing right-sided irregular precast pocketed L-wall.

In certain embodiments the bridge systems may comprise a single load-bearing, regular precast pocketed L-wall. In certain embodiments the bridge systems may comprise the load-bearing right-sided irregular precast pocketed L-wall having one edge positioned adjacent and fastened to a mating edge of the non-load-bearing left-sided irregular precast L-wall at an angle $\beta$, and the non-load-bearing right-sided irregular precast L-wall having one edge positioned adjacent and fastened to a mating edge of the load-bearing left-sided irregular precast pocketed L-wall at the angle $\beta$, where the angle $\beta$ ranges from about 20 to about 40 degrees. Certain other embodiments may comprise precast foundation slabs positioned under each of components (a), (b), (c), (d), and (e). In certain embodiments the bridge systems may comprise one or more auger piles securing the precast foundation slabs to soil under each of the precast foundation slabs. In certain other embodiments the bridge system may be devoid of auger piles. Methods of installing such bridge systems are considered another aspect of the present disclosure.

The proposed prestressed panels, L-walls, double-T members, and foundation slabs may be cast in a prestress manufacturing facility under a controlled environment with state-of-the-art production equipment and technology. The prestress concrete plant produces thousands of square feet per day in an efficient automated production line. The prestressed components can be produced ahead of schedule and delivered on a timely basis to improve the project schedule. The production plant is an indoor facility not subject to weather conditions that can affect any onsite construction activity. There are considerable cost and schedule savings to both the contractor and the owner by utilizing our prestress concrete components, systems, and methods. The time savings also affects the traveling public safety and delays by having shorter timeframes for construction detours, road closures and safety.

These and other features of the systems and methods of the disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain apparatus, systems, and methods may comprise a few physical components and features but may be devoid of certain optional hardware and/or other features. In certain systems and methods, for example, the bridge system may be devoid of wire cage reinforcements, or devoid of auger piles. Bridge systems may be devoid of components that would render them unsafe, according to American Association of State Highway and Transportation Officials (AASHTO) standards and other industry standards discussed herein. As used herein "generally planar" means nominally planar, that the panels may differ from being exactly planar by inclusions, imperfections, and the like in the concrete, as well as slight changes in thickness from edge to edge, for example 1 or 2 percent difference. As used herein "controlled environment", also sometimes referred to as a critical environment, is a space where pressure, temperature, and humidity are controlled, and is separated from other operations. If there is chance that airborne particles may be a concern to the concrete curing process, standards for particle contamination may be considered, although this is rare. According to the National Precast Concrete Association, along with the right water/cementitious ratio, a controlled environment facilitates curing of freshy cast concrete, because hydration is a thermally dependent process. Higher temperatures (for example 80° F. and above) accelerates hydration, and low temperature slow it down. Ambient temperatures below 50° F. (10° C.) are not preferred, because when concrete falls below 40° F. (4.5° C.), hydration virtually stops. Further, while not strictly an environmental concern, by "controlled environment" we also mean ensuring raw ingredients meet quality standards, calculating the best mix design and training personnel on how to batch, place, and consolidate the concrete ingredients.

BRIEF DESCRIPTION OF THE DRAWINGS

The manner in which the objectives of this disclosure and other desirable characteristics can be obtained is explained in the following description and attached drawings in which:

FIG. 11 is a logic diagram of one non-limiting method of installing a bridge system in accordance with this disclosure;

FIG. 151 is a schematic cross-sectional view of one of the pocketed L-walls of the embodiment illustrated in FIG. 15;

It is to be noted, however, that the appended drawings may not be to scale and illustrate only typical embodiments of this disclosure. Furthermore, FIG. 11 illustrates only one of many possible methods of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

Figure 1:
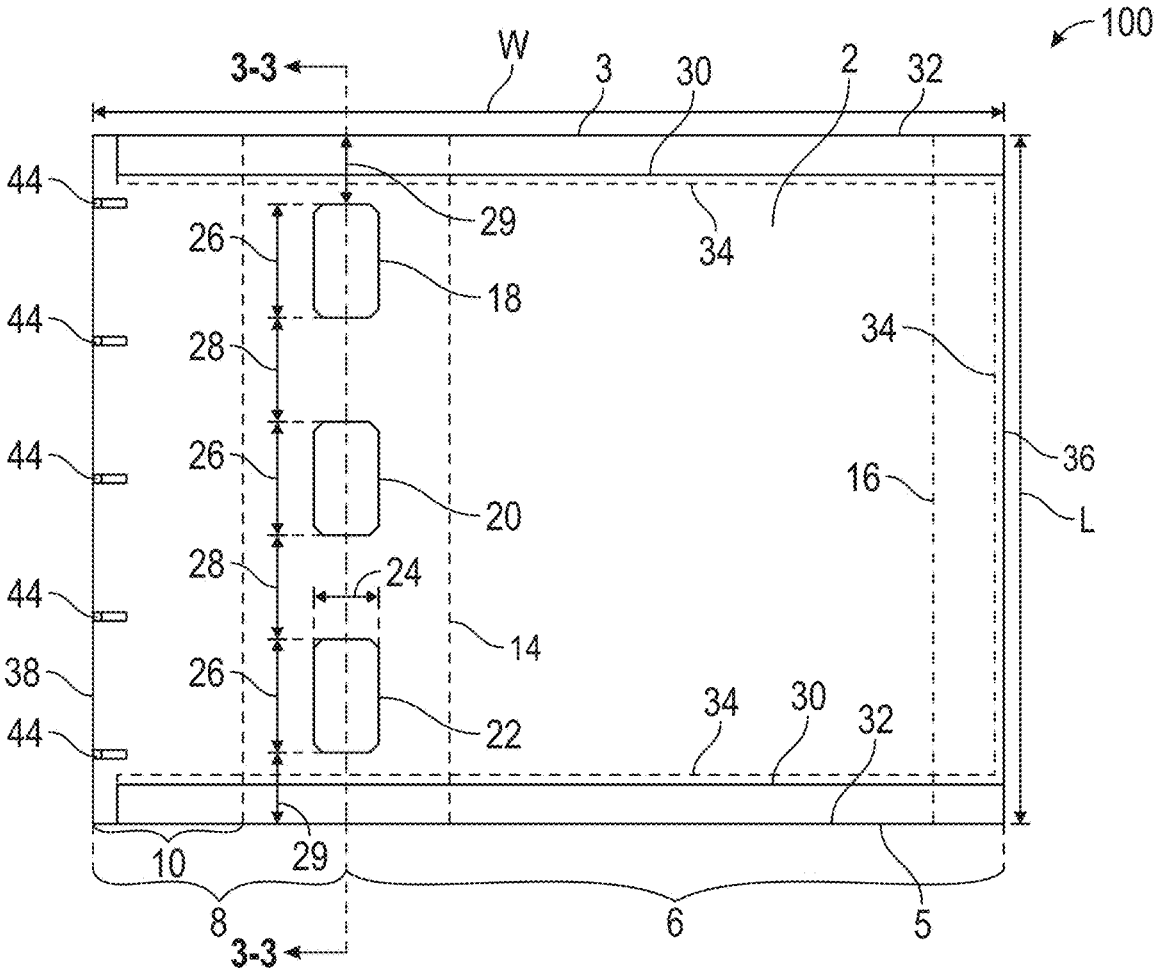
FIG. 1 is a schematic plan view illustration of one panel embodiment 100 of the present disclosure.

In the following description, numerous details are set forth to provide an understanding of the disclosed apparatus, systems and methods. However, it will be understood by those skilled in the art that the systems and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced.

Where a range of values describes a parameter, all subranges, point values and endpoints within that range are explicitly disclosed herein.

The various embodiments of the present disclosure address the deficiencies in existing bridge systems and methods, particularly those with overhang traffic surfaces, and provide increased safety and reduced cost and complexity in comparison to existing systems and methods. The various system embodiments of the present disclosure comprise systems made largely of concrete elements, in certain embodiments precast and/or prestressed concrete elements. Systems and methods of the present disclosure introduce new concepts: use of precast, prestressed concrete panels supported by load bearing support structures, and use of precast, prestressed concrete double-T members supported by pocketed L-walls that are in turn supported by precast foundation slabs. These concepts greatly increase consistency of strength and life of concrete bridges, as well as safety during construction compared to existing systems in the marketplace.

Apparatus, systems, and methods of the present disclosure offer time saving on site for excavation, concrete work, foundations, assembly and backfill. Systems and methods of the present disclosure may be installed on site in a much shorter time frame compared with conventional bridge systems.

The primary features of the systems and methods of the present disclosure will now be described with reference to the drawing figures, in which some of the construction and operational details, some of which are optional, will be further explained. The same reference numerals are used throughout to denote the same items in the figures. Those skilled in this art will know the basics of producing precast and prestressed concrete. Sources of background information include the Precast Concrete Institute (PCI); American Association of State Highway and Transportation Officials (AASHTO); National Precast Concrete Association (NPCA); and American Society of Testing materials (ASTM), to name a few.

Figure 8:
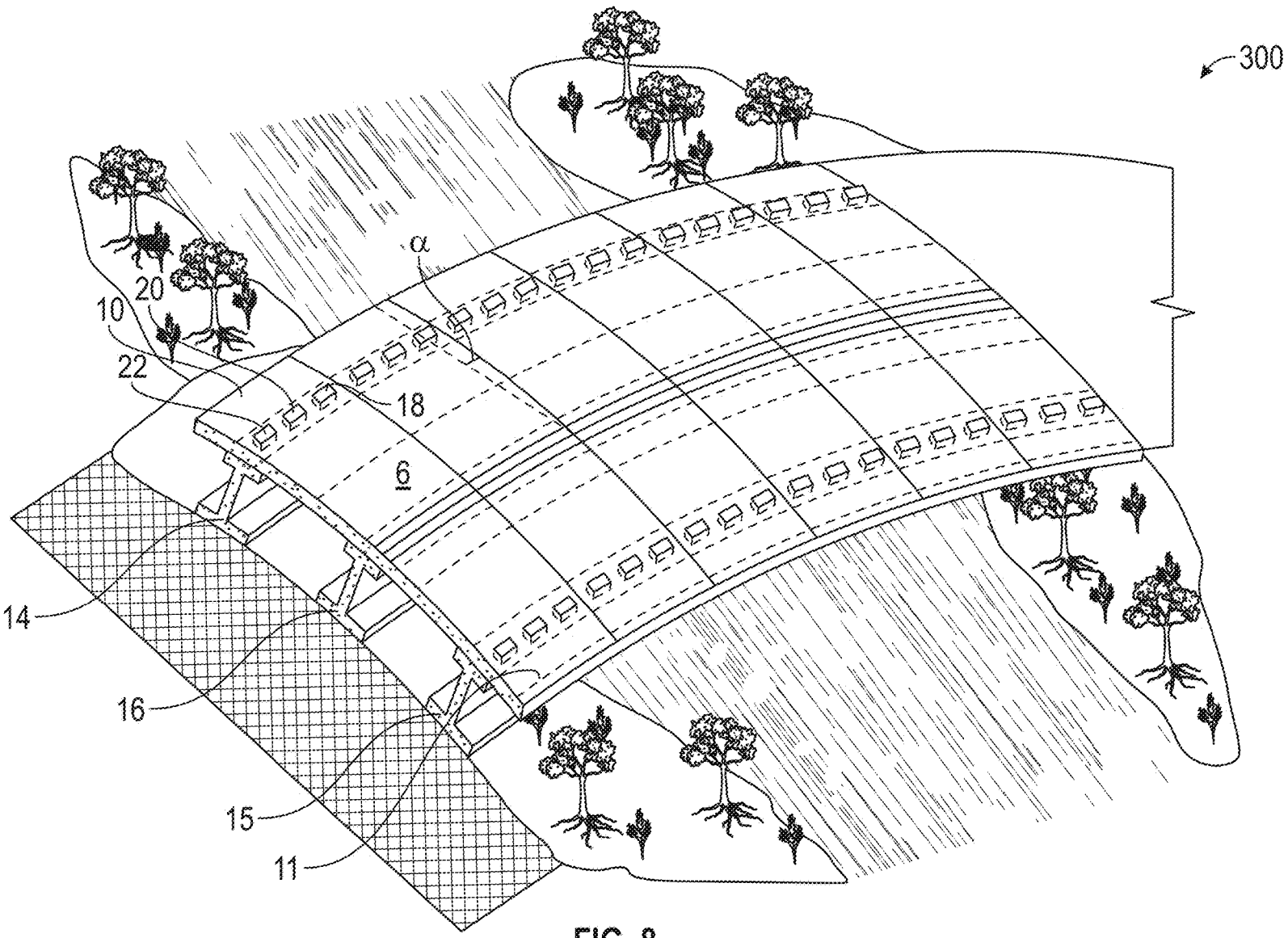
FIG. 8 is a schematic perspective view illustration of a bridge constructed using a plurality of panels of the present disclosure.

Certain panel embodiments, such as panel embodiment 100 illustrated schematically in FIGS. 1-4, may comprise a panel top surface 2, and a panel bottom surface 4, as well as a panel leading edge 3, a panel trailing edge 5. Panel 100 further comprises a traffic panel section 6 and an overhang panel section 8. Panel 100 has a length L, width W, and thickness t, and further includes an overhang portion 10 of overhang panel section 8, and as illustrated in FIG. 8 a second overhang panel section 11. Overhang portion 10 has a length 12.

Figure 2:
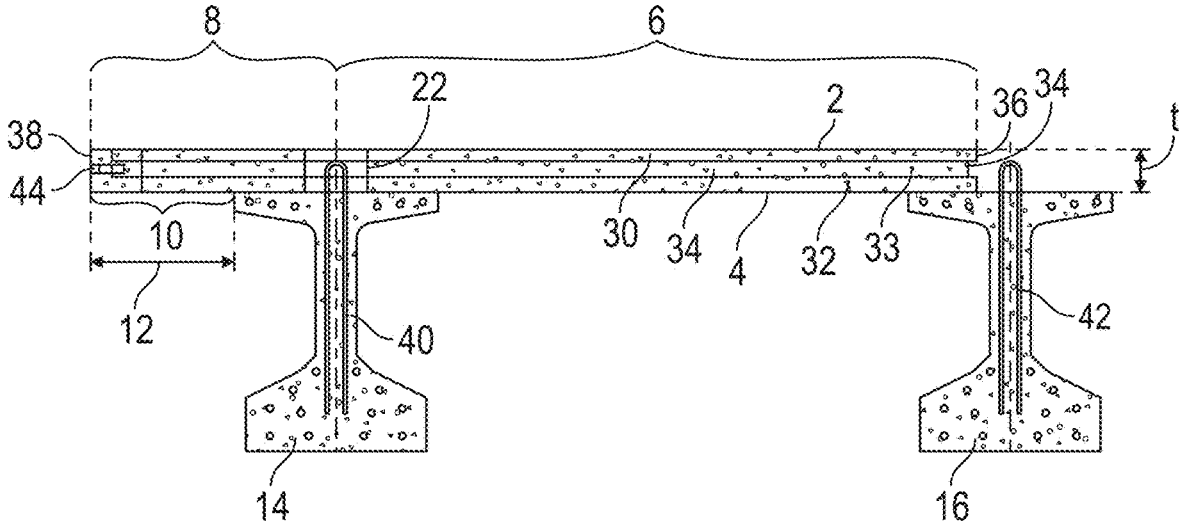
FIG. 2 is a schematic cross-sectional view, with some features in phantom, of a supported panel embodiment illustrated schematically in FIG. 1.
Figure 3:
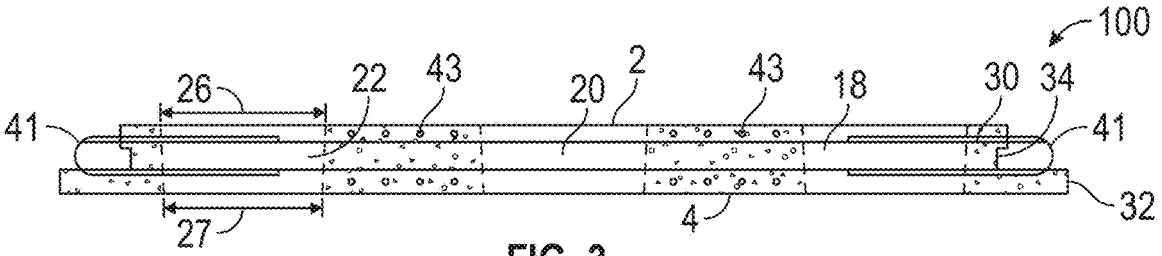
FIG. 3 is a schematic cross-sectional view, taken along the line 3-3, of panel embodiment 100 illustrated schematically in FIG. 1.

Referring to FIGS. 1 and 2, panel 100 features octagonal block outs or voids 18, 20, and 22 for placing wire mesh cages for closure pour of concrete to connect panel 100 to an outer prestressed concrete girder support 14. Certain bridge embodiments include a second outer prestressed concrete girder support 15, as illustrated schematically in FIG. 8. An inner (or center) prestressed concrete girder support 16 is illustrated in FIG. 2. Other panel embodiments may have fewer or more than two block outs or voids (which do not have to be octagonal), such as panel embodiment 200 illustrated in FIGS. 5, 6, and 7, which has four octagonal block outs or voids 18, 19, 20, and 22. Width 24 of block outs 18, 10, and 22 is indicated, as well as length 26. A second, shorter length 27 is illustrated in FIG. 3 for the bottom of each block out or void. In other words, length 27<length 26. A distance 28 between block outs or voids 18, 20, 22 is indicated, as is a distance 29 from panel leading edge 3 to block out or void 18, and from trailing edge 5 to block out or void 22 (or block out or void 19 in panel embodiment 200).

Panel embodiment 100 may be described as having a generally planar upper panel portion 30, a generally planar bottom panel portion 32, and a generally planar central panel portion 33, with a concave cutout 34 on leading edge 3, trailing edge 5, and inner edge 36 of panel 100. Panel 100 may be cast concrete so that these panel portions are integral or separate. An overhang edge 38 of panel overhang section 10 is also illustrated schematically.

Figure 4:
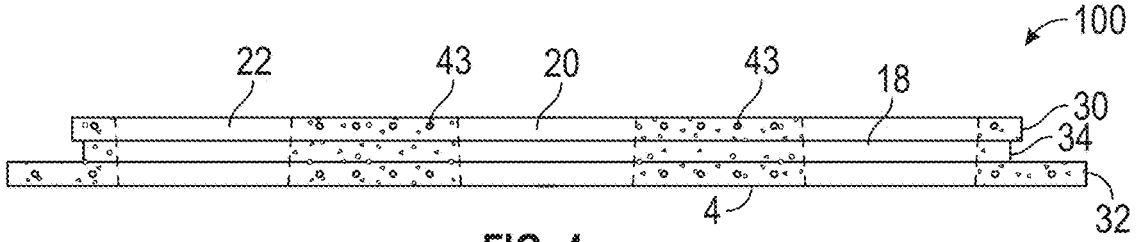
FIG. 4 is a schematic end view, with portions in phantom, of panel embodiment 100 illustrated schematically in FIG. 1.

FIG. 2 is a schematic cross-sectional view, with some features in phantom, of a supported panel 2 illustrated schematically in FIG. 1, and FIG. 3 is a schematic cross-sectional view, taken along the line 3-3, of panel embodiment 100 illustrated schematically in FIG. 1. FIG. 4 is a schematic end view, with portions in phantom, of panel embodiment 100 illustrated schematically in FIG. 1. FIG. 2 illustrates schematically vertical U-shaped reinforcing steel 40 (commonly known as "rebar") in 14 (available in diameters of 10, 12, 14, 16 mm) and having dimensions (mm): 1000×200×1000, or 1000×300×1000, or 1000×500×1000. Similar vertical U-shaped steel wire reinforcements 42 are positioned in prestressed concrete girder support 16. As illustrated schematically in FIG. 3, one or more horizontal U-shaped reinforcing steel members 41 may be positioned in panels 100 with their end U-portions projecting out of the panel and subsequently surrounded with poured concrete. As illustrated schematically in FIGS. 1, 2, 5, and 6, headed concrete anchors (HCAs) 44 may be provided to bolt steel plate forms to the panels so that contractors can strike off top of paving surface. Headed concrete anchors, U-shaped reinforcements, and wire cages are typically galvanized metal (zinc-coated iron or steel), although that may not be required in all embodiments.

Figure 5:
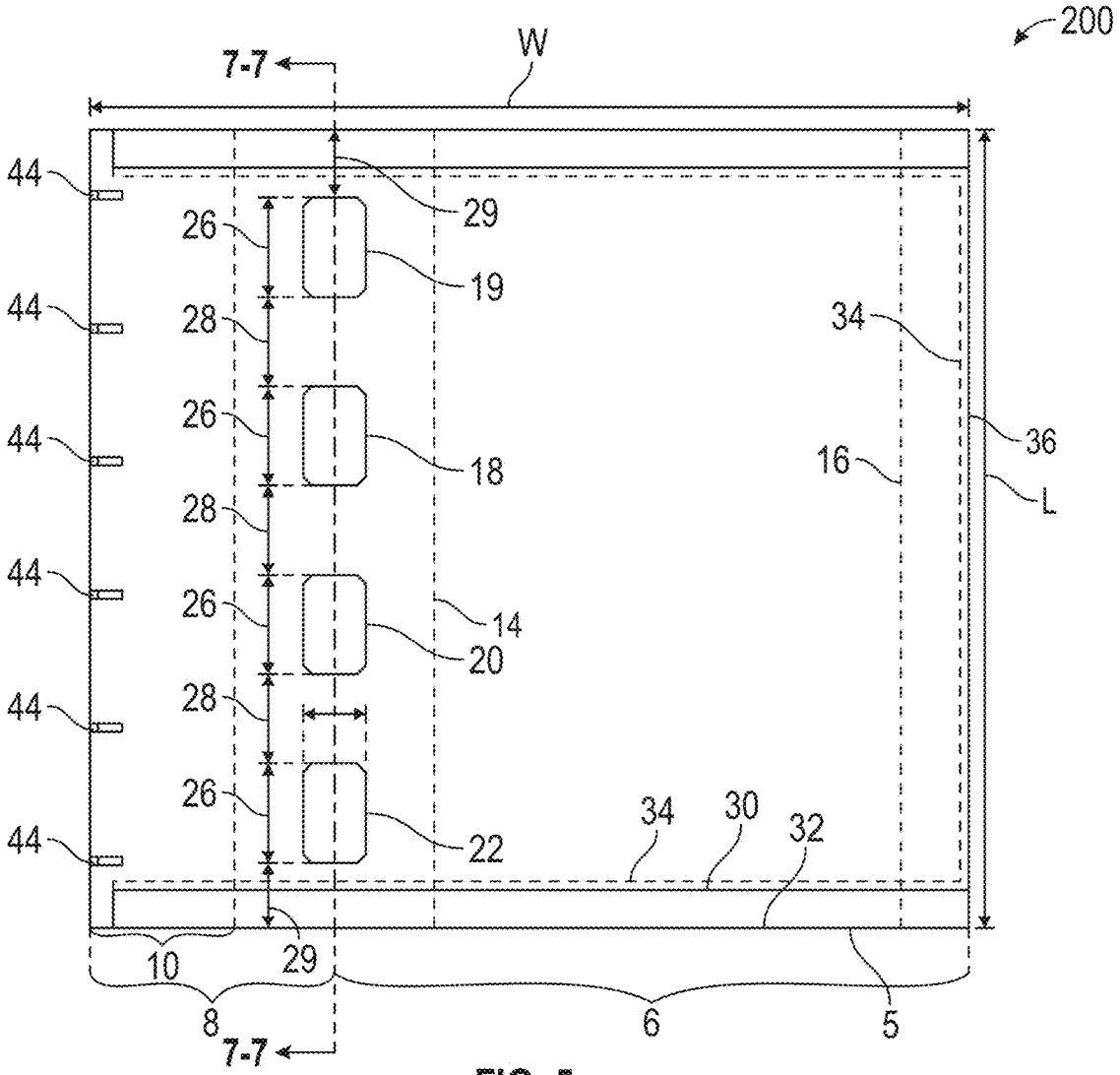
FIG. 5 is a schematic plan view illustration of another panel embodiment 200 of the present disclosure.
Figure 6:
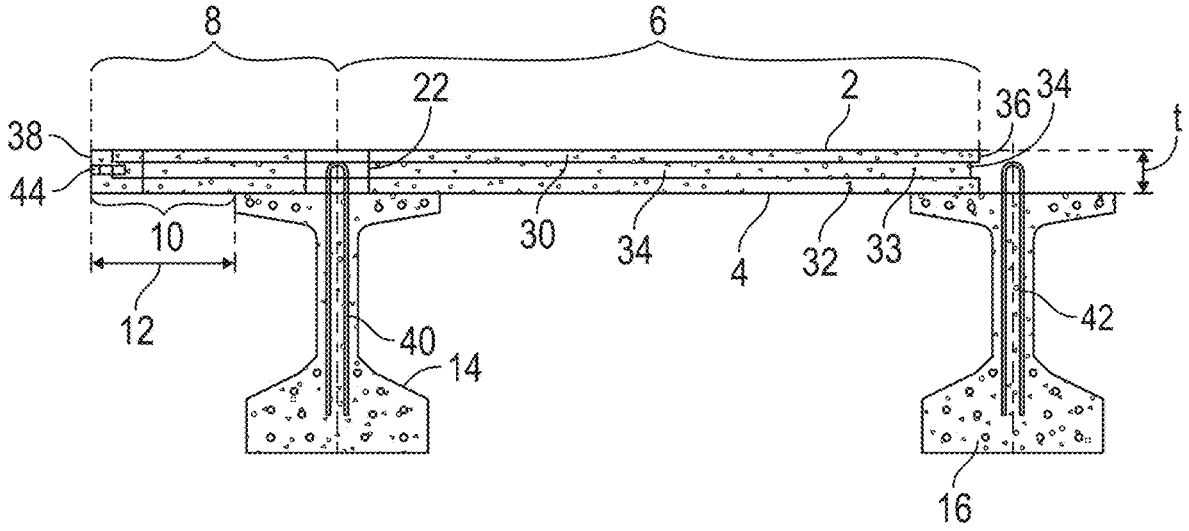
FIG. 6 is a schematic cross-sectional view illustration, with some features in phantom, of a supported panel embodiment illustrated schematically in FIG. 5.
Figure 7:
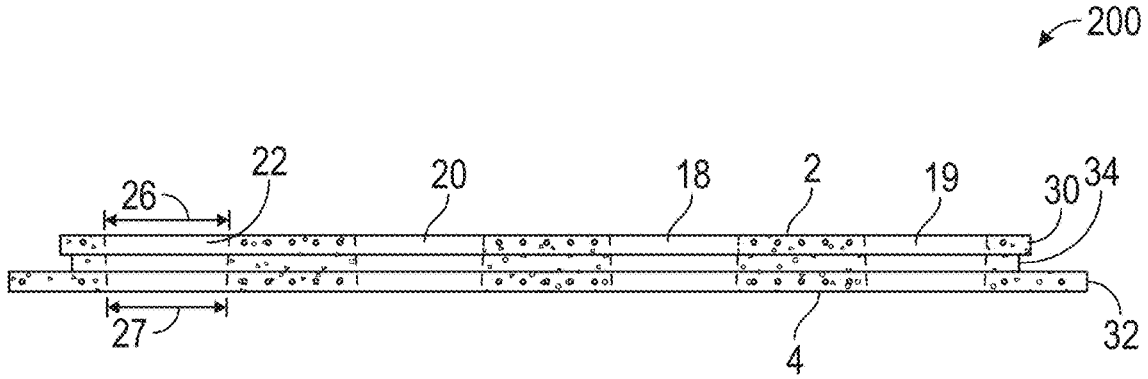
FIG. 7 is a schematic end view illustration, with portions in phantom, of panel embodiment 200 illustrated schematically in FIG. 5.

FIG. 5 is a schematic plan view illustration of another, larger panel embodiment 200 of the present disclosure; FIG. 6 is a schematic cross-sectional view illustration, with some features in phantom, of a supported panel embodiment illustrated schematically in FIG. 5; and FIG. 7 is a schematic end view illustration, with portions in phantom, of panel embodiment 200 illustrated schematically in FIG. 5. Panel embodiment 200 is substantially the same as panel embodiment 100 except that it has four block outs or voids 18, 19, 20 and 22, due to the slightly larger size. Panel 200 may be a 12 ft. square panel, while panel 100 may be a 10 ft. square panel. Other sizes and shapes are considered within the present disclosure and claims. In certain embodiments the panels may exhibit a trapezoidal shape due to road or bridge curvature or radius. The radius angle $\alpha$ of a horizontal bridge or roadway may range from about 1 to about 10 degrees, or from about 1 to about 5 degrees. FIG. 8 is a schematic perspective view illustration of a bridge embodiment 300 constructed using a plurality of panels of the present disclosure, illustrating the radius angle $\alpha$. The bridge system embodiment 300 as illustrated in FIG. 8 would then have the traffic surface poured by a contractor to thickness needed as per horizontal and vertical camber to create an at least 2 inch thick traffic surface.

Figure 9:
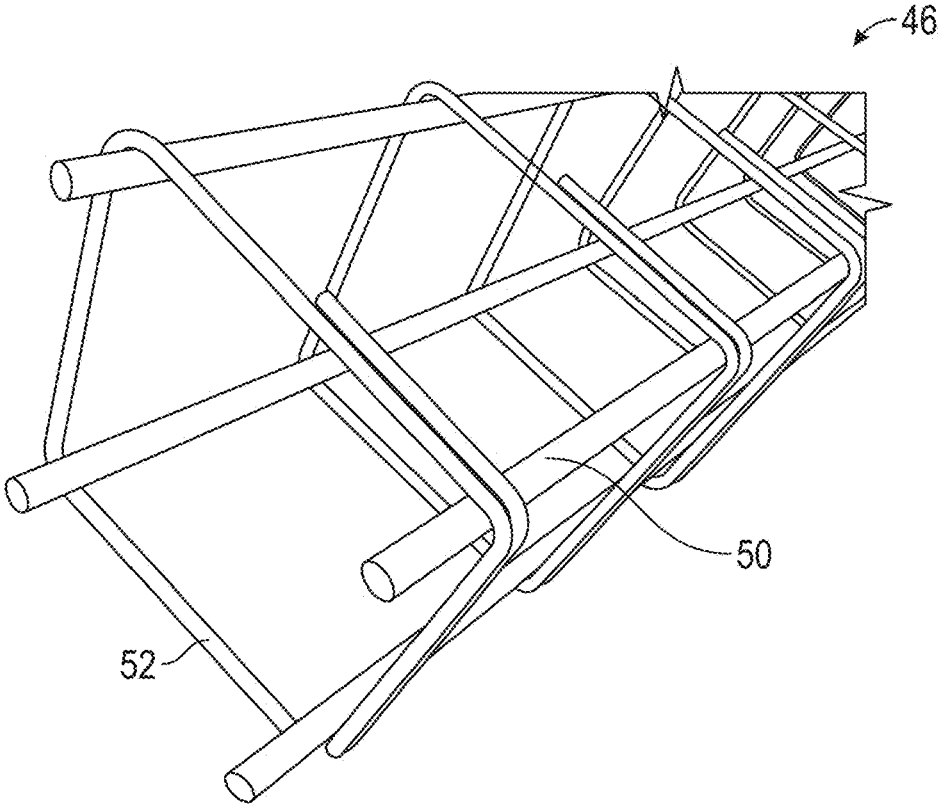
FIG. 9 (Prior Art)
FIGS. 9 and 10 are perspective view illustrations of two wire cages useful in constructing bridges using panels of the present disclosure.
Figure 10:
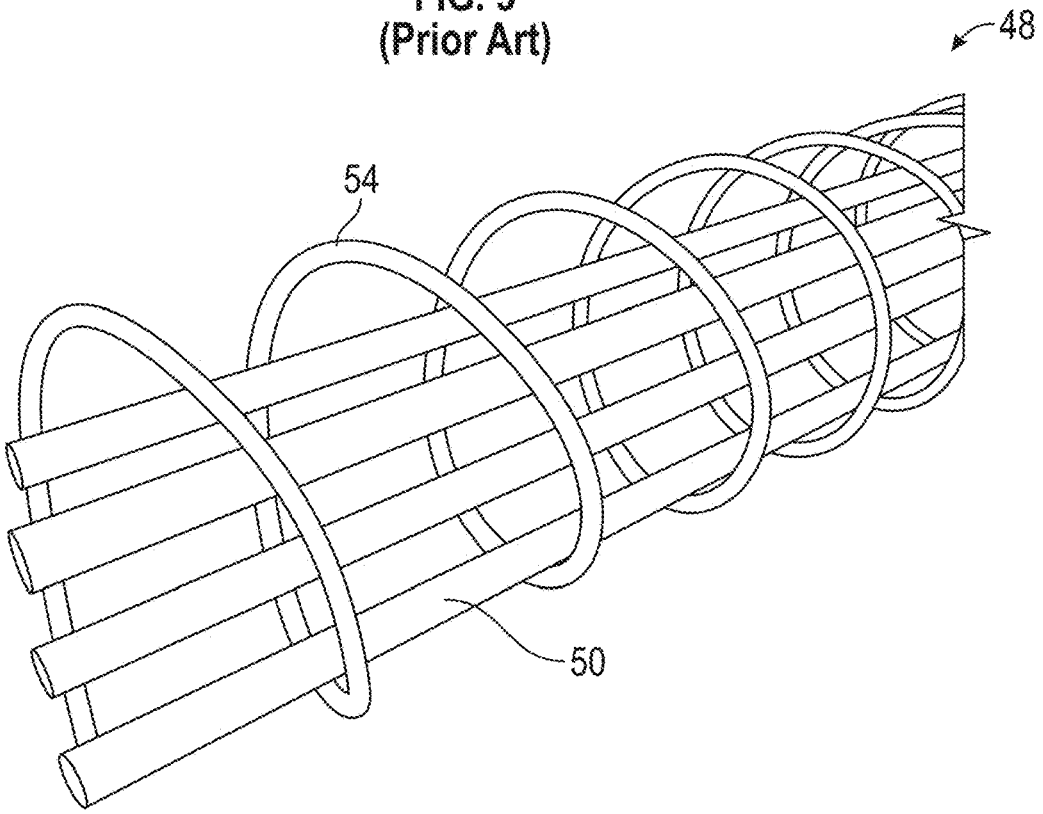
FIG. 10 (Prior Art)

FIGS. 9 and 10 are perspective schematic view illustrations of two wire cages useful in constructing bridges using panels of the present disclosure, as currently available commercially from Suprete™ Concrete Mesh Products, East Industrial Zone, Anping, Hebei, China. The prefabricated wire mesh square cage 46 illustrated schematically in FIG. 9 is a square mesh for closure poor and may be for example 200×200 mm square. The prefabricated wire mesh round cage 48 illustrated schematically in FIG. 10 is a round mesh for closure poor, and may have dimensions, for example for the main steel wire 50 may for example be 12-, 16-, or 20-mm diameter. In embodiment 46, reinforcing steel square (rectangular also available) links 52 comprise high tensile strength reinforcing steel wire, for example 6 mm, 8 mm, 10 mm, 12 mm, and 14 mm diameter, while the square mesh may be 300 mm×300 mm, 350 mm×350 mm, 400 mm×400 mm, or 450 mm×450 mm. In embodiment 48, steel wire 54 may comprise, for example cage diameter 200 mm, with main steel bars 50 being 12-, 16-, or 20-mm diameter, with round spiral wire of 8 or 10 mm. It should be understood that we intend that in addition to wire cages, or in lieu of wire cages, conventional rebar, steel wire reinforcement (also called welded wire), and prestress wire strand may be employed. The type, size, and length of wire cages 46, 48, rebar, steel wire reinforcement, prestressed wire strand, and weld materials, depend on the specific loads and other construction details.

Table 1 provides broad and narrow ranges for various panel dimensions.

TABLE 1

Dimensions for Panels

| Feature | Broad range (meters) | Less broad range (meters) |
|---|---|---|
| L | 0.5-20 | 3-15 |
| W | 0.5-20 | 3-15 |
| t | 0.1-0.5 | 0.1-0.3 |
| α | 0-10 degrees | 0.1-5 degrees |
| 26 | 0.1-1.0 | 0.1-0.33 |
| 27 | (0.50-0.99) × 26 | (0.75-0.90) × 26 |
| 28 | 0.1-1.0 | 0.1-0.33 |
| 29 | 0.1-0.5 | 0.1-0.3 |
| 6 | (0.6-0.8) × W | (0.65-0.75) × W |
| 8 | (0.2-0.4) × W | (0.25-0.35) × W |

Panels described herein may be joined by pouring uncured concrete into the blocks or voids 18, 19, 20, and 22 after delivery and placement at the bridge site, and into voids between abutting or facing panels where the inside edges of two panels face each other, at the top of prestressed concrete girder support 16 for example (as illustrated schematically in FIGS. 2, 6, and 8), and curing the concrete. Depending on local law and regulations, a concrete traffic surface of 2 or more inches thickness is poured (cast in place) over top surface 2 of panels 100, 200. As the tops of the prestressed concrete girders are cambered according to the terrain, the horizontal and vertical cambers of the traffic surface may dictate varying thickness of the cast in place traffic surface.

FIG. 11 is a logic diagram of one non-limiting method of installing a bridge system (box 402) in accordance with this disclosure. Method embodiment 400 includes the steps of a) delivering a plurality of generally rectangular, precast, prestressed concrete panels to an installation site, each of the generally rectangular, precast, prestressed concrete panels having: i) a length L, a width W, a thickness t, a top surface, a bottom surface, a leading edge, a trailing edge, an inner edge, and an overhang edge; ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W; iii) the generally planar panel upper portion having same width W as the generally planar bottom panel portion, and having a length l that is less than the length L, while the generally planar bottom panel portion has a length L; iv) a concave cutout formed in the inner edge, the leading edge, and the trailing edge; and v) at least one block out or void for placing wire mesh cages for closure pour of concrete to connect the generally rectangular, precast, prestressed concrete panel to a support (box 404); b) delivering one or more support beams to the installation site, each support beam having a support and a base (box 406); c) positioning the plurality of generally rectangular, precast, prestressed concrete panels on the supports of the one or more support beams with an overhang panel section and a traffic panel section (box 408); d) optionally backfilling over the bases of the at least one support beams (box 410); and e) connecting the generally rectangular, precast, prestressed concrete panels to the support beams by positioning wire mesh cages in the at least one block out or void, pouring unsolidified concrete into the at least one block out or void, and curing the unsolidified concrete to form an overhang traffic surface (box 412).

Figure 12:
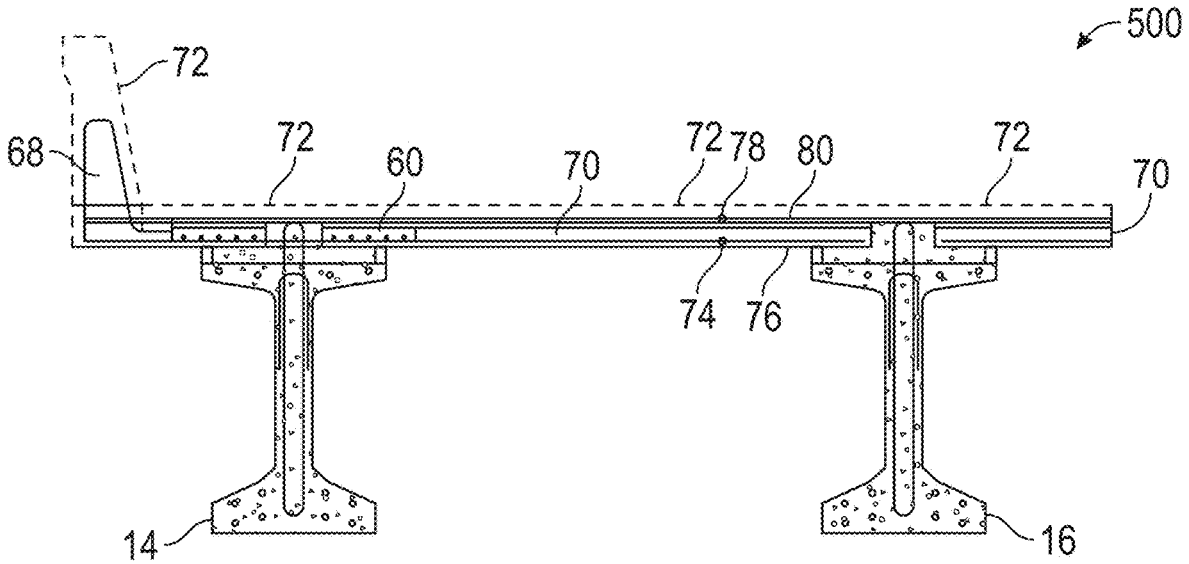
FIG. 12 is a schematic cross-sectional view, with some features in phantom, of a second supported panel embodiment, with FIG. 12A being a schematic side-elevation view of a bridging plate used in such embodiments.
Figure 12A:
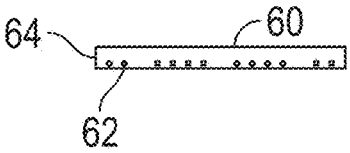
Figure 13:
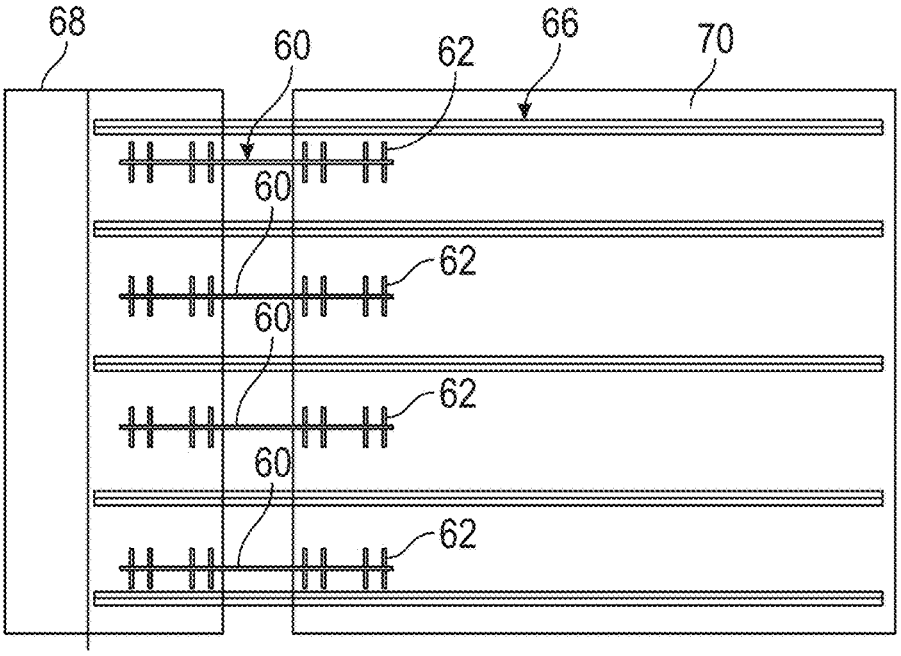
FIGS. 13, and 14 are schematic plan and end views, respectively, of the second supported panel embodiment illustrated in FIG. 12.
Figure 14:
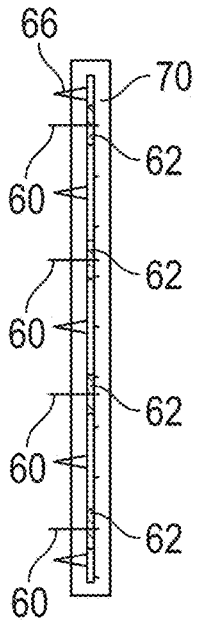

FIG. 12 is a schematic cross-sectional view, with some features in phantom, of a second supported panel embodiment 500, with FIG. 12A being a schematic side-elevation view of a bridging plate used in such embodiments. FIGS. 13 and 14 are schematic plan and end views, respectively, of the second supported panel embodiment illustrated in FIG. 12. In embodiment 500, one or more bridging plates 60 may be precast into precast traffic panels 70, bridging plates 60 further secured in precast traffic panels 70 with one or more studs 62 positioned on both sides of the bridging plates 60 by welding studs 62 to bridging plates 60 using a stud welding machine, such as a capacitor discharge stud welding machine, or an arc stud welding machine. Such studs and stud welding machines are commercially available, for example from Midwest Fasteners, Inc., Miamisburg, Ohio (U.S.A.). Studs are available in numerous sizes, flanged and non-flanged, threaded or non-threaded, and materials may be low carbon steel (0.23 wt. percent max. carbon), stainless steel (for example, 302, 304, 305), aluminum, brass, and the like, and in some embodiments may be copper plated (especially low carbon steel studs, but not stainless steel studs) and annealed. Holes or slots 64 are provided in bridging plates 60 to accommodate transverse bars 74 cast into precast traffic panels 70. Longitudinal bars 76 are also cast into precast traffic panels 70. A truss wire 66 assists securing precast overhang panels 68 to the precast traffic panels 70. To complete the construction on-site, cast-in-place (CIP) concrete 72 (indicated by dashed lines) is poured over precast traffic panels 70 and precast overhang panels 68, as well as filling gaps between ends of precast traffic panels 70 and precast overhang panels 68, as illustrated schematically in FIGS. 12 and 13. Transverse bars 78 and longitudinal bars 80 may be provided in the CIP concrete.

The CIP concrete and precast concrete may have similar thicknesses, although embodiments where the CIP concrete thickness is more or less than the precast concrete thickness are considered within this disclosure, as long as the bridge is structurally sound for its intended purpose. Bridging plates, transvers bars, longitudinal bars, and truss wires are typically galvanized metal, (zinc coated iron or steel), although that may not be required in all embodiments. In certain embodiments the bridging plates, studs, bars, and truss wires all have common or very similar metallurgy to avoid galvanic corrosion, but this may not be necessary in all embodiments.

Figure 15:
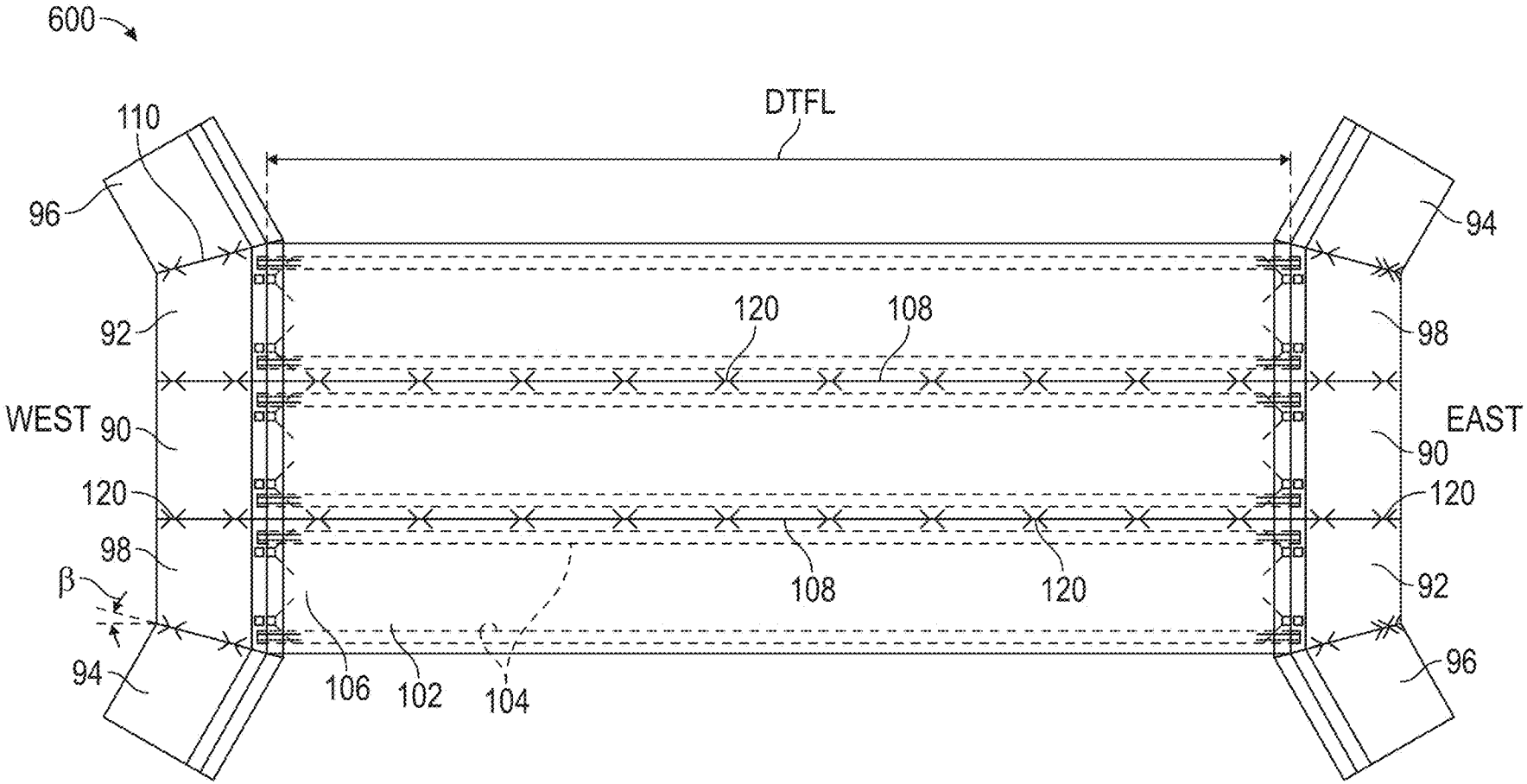
FIG. 15 is a schematic plan view, with some features in phantom, of another bridge system embodiment in accordance with the present disclosure, comprised of precast concrete L-walls (some having pockets) supported by precast concrete foundation slabs, and with a plurality of double-T members supported by the pocketed L-walls.

FIG. 15 is a schematic plan view, with some features in phantom, of another bridge system embodiment 600 in accordance with the present disclosure, comprised of precast concrete L-walls (some having pockets, such as regular L-wall 90 and irregular L-walls 92 and 98) supported by precast concrete foundation slabs (hidden in FIG. 15), and with a plurality of double-T members 102 supported by the pocketed L-walls. Non-load-bearing, non-pocketed L-walls 94, 96 are included on the sides of the structure. Webs 104 of the double-T members are illustrated in phantom, with 106 being the span of double-T members, 108 being joints between double-T members, and 120 being welded connectors, as further explained herein. "DTFL" in FIG. 15 indicates "double-T flange length", while the angle β represents the angle between pairs of non-load-bearing non-pocketed irregular L-walls and load-bearing pocketed irregular L-walls, such as pairs 94, 98, and pairs 92, 96 on each end of bridge embodiment 600. For convenience, one end is referred to as the west end "WEST", and the other end is referred to as the east end "EAST". As used herein "regular" L-wall means having a plan shape that is rectangular, while "irregular" L-wall means having non-bi-laterally symmetrical trapezoidal shape. Joints 108 between double-T members, and joints 110 between precast L-wall members are noted in FIG. 15. L-wall 90 is a load-bearing, regular precast pocketed L-wall; L-wall 92 is a load-bearing, right-sided irregular precast pocketed L-wall; L-wall 94 is a non-load-bearing, right-sided irregular precast pocketed L-wall; L-wall 96 is a non-load-bearing, left-sided irregular precast pocketed L-wall; and L-wall 98 is a load-bearing, left-sided irregular precast pocketed L-wall.

Figure 15A:
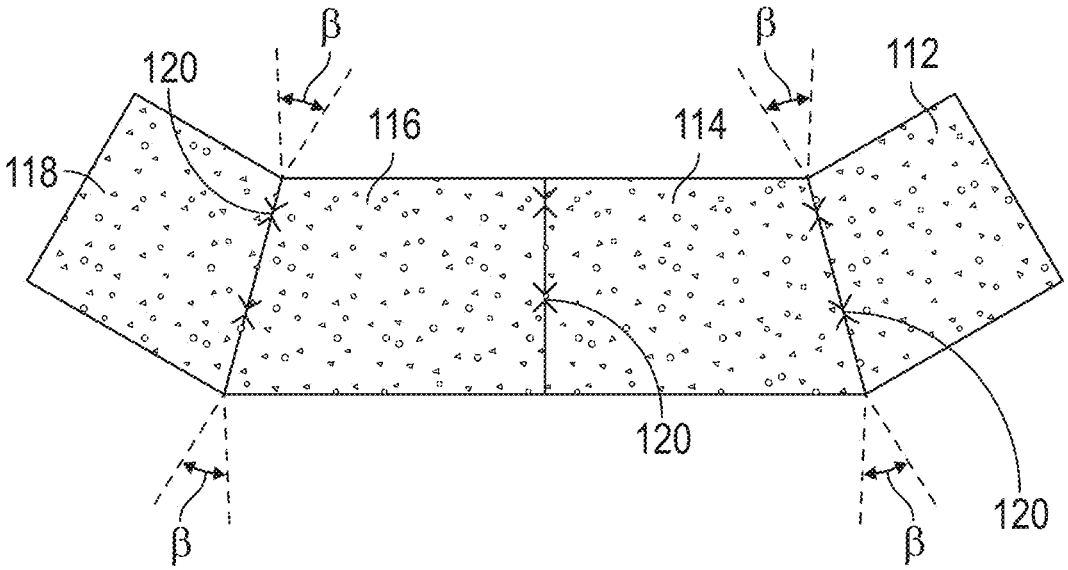
FIGS. 15A and 15B are plan views of the precast concrete foundation slabs of the embodiment illustrated in FIG. 15.
Figure 15B:
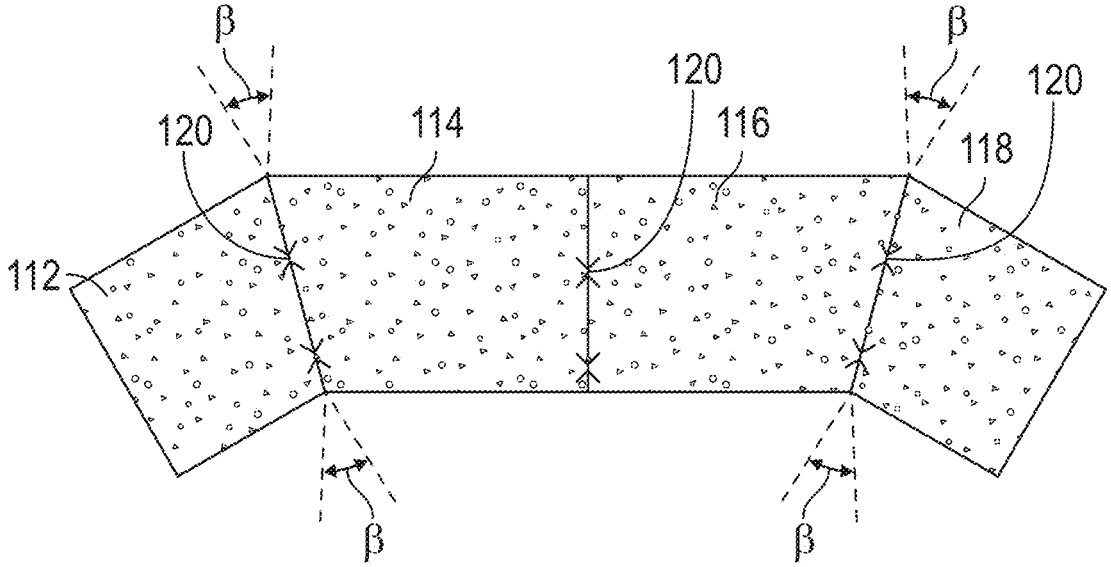
Figures 15C, 15D, 15E:
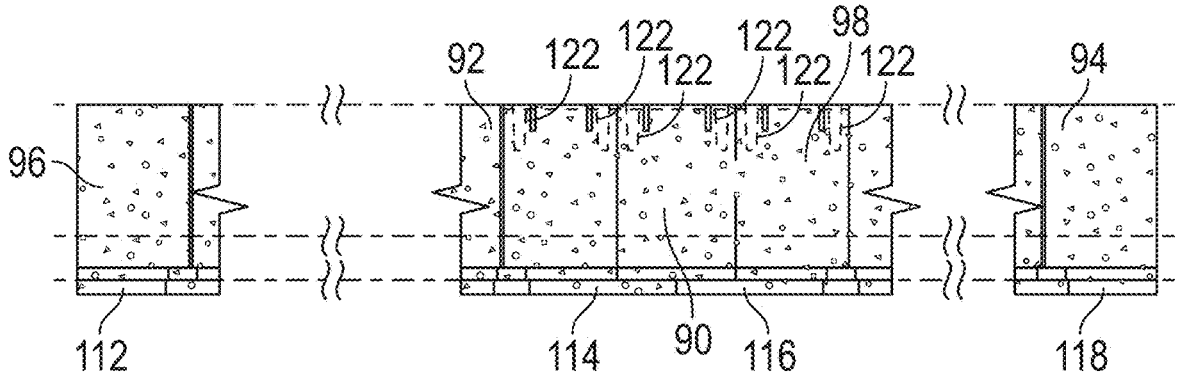
FIGS. 15C, 15D, and 15E are elevation views of the west-end L-walls.
Figures 15F, 15G, 15H:
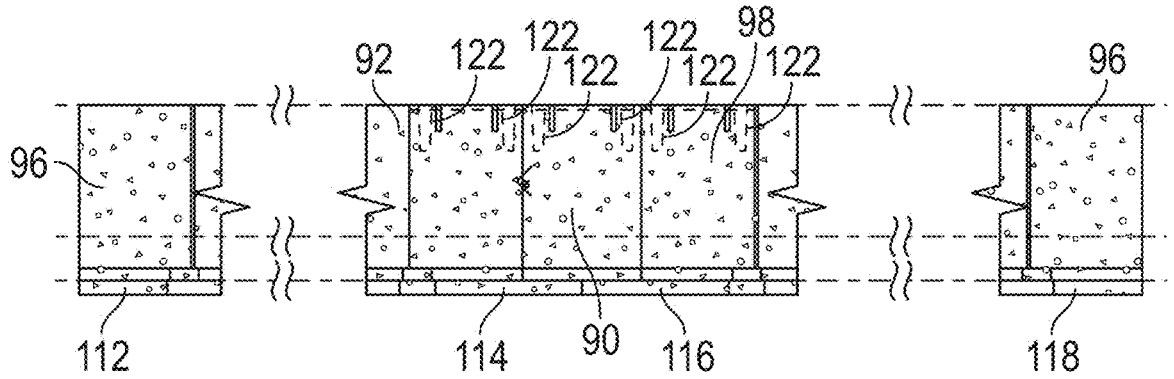
FIGS. 15F, 15G, and 15H are elevation views of the east-end L-walls.
Figure 15I:
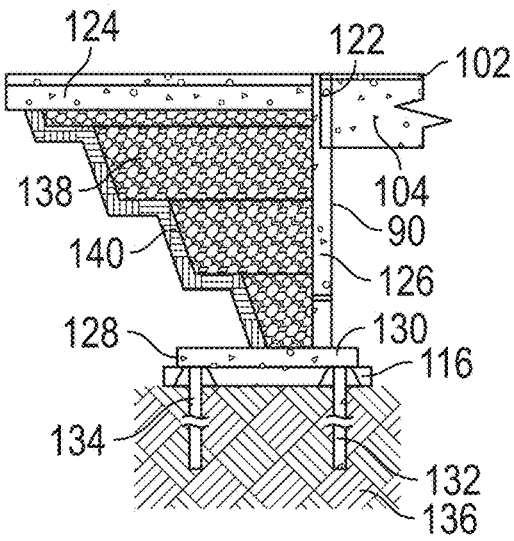

FIGS. 15A and 15B are plan views of the west and east precast concrete foundation slabs 112, 114, 116, and 118 of embodiment 600 illustrated in FIG. 15. Embodiment 600 features only non-bi-laterally symmetrical trapezoidal shaped slabs, but other embodiments may include bi-laterally symmetrical trapezoidal shaped slabs and other tetragonal-shaped slabs (such as rectangular) may be used. Foundation slab 112 is a non-load-bearing, left-sided precast foundation slab; foundation slab 114 is a load-bearing, right-sided precast foundation slab; foundation slab 116 is a load-bearing, left-sided precast foundation slab; and foundation slab 118 is a non-load-bearing, right-sided precast foundation slab. FIGS. 15A and 15B also illustrate the welded connections 120 between adjacent foundation slabs. Welded connectors are known, and one type, a "Vector" connector, is explained in further detail herein when discussing the connections between double-T members. FIGS. 15C, 15D, and 15E are elevation views of the west-end L-walls, with pockets 122 in phantom; FIGS. 15F, 15G, and 15H are elevation views of the east-end L-walls, with pockets 122 in phantom, and FIG. 15I is a schematic cross-sectional view of one of the pocketed L-walls of the embodiment illustrated in FIG. 15. A roadbed 124 beyond the bridge is illustrated abutting adjacent atop of L-wall 90, which in turn abuts an adjacent web 104 of double-T member 102. L-wall 90 includes a stem 126, a forebase 128, and a hindbase 130. Auger piles 132, 134 are illustrated placed into bedrock 135 or other earthen formation, although they may not be required in all embodiments. Cement stabilized backfill (rock or other) 138 and precast or CIP reinforcement 140 for 138 is provided.

Figure 16:
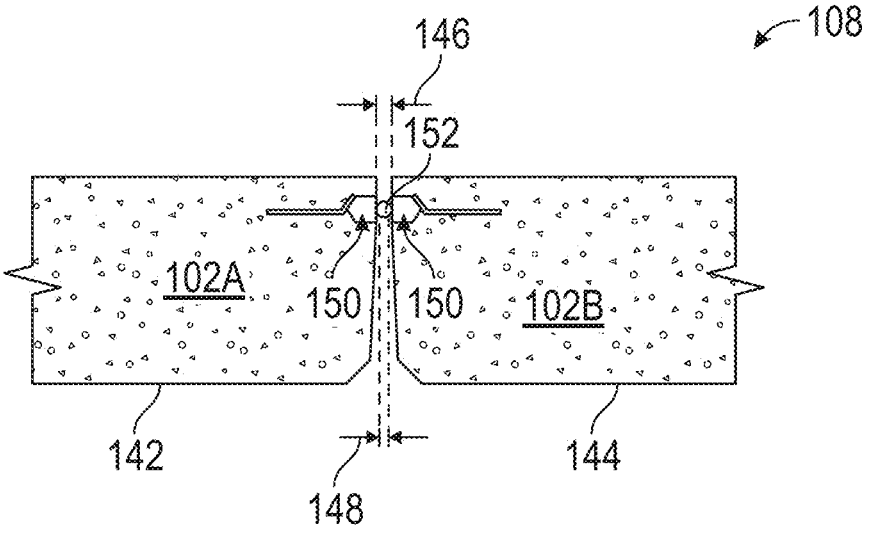
FIG. 16 is a detailed schematic elevation view of a joint between two double-T members useful in the embodiment of FIG. 15.

FIG. 16 is a detailed schematic elevation view of a joint between two double-T members 102A, 102B useful in embodiment 600 of FIG. 15 and other embodiments illustrating a flange 142 of double-T member 102A, a flange 144 of double-T member 102B. Certain embodiments feature a greater (upper) width 146 of joint vector connector 150, and a lesser (lower) width 148 of a vector connector 150. Width 146 may range from about 2 inches to about 0.5 inch, while width 148 may range from about 0.25 inch to about 1 inch, with the proviso that width 146>width 148. Vector connector 150 is a specific type of welded connector available from JVI, Inc., Lincolnshire, Illinois, and may be used either as stainless steel, or carbon steel with J-coat finish. The J-coat finish features zinc plating per ASTM B633 FE/Znl2 Type II, SC3 Severe test, having a minimum thickness of 0.0005 inch; a trivalent clear chromate dip (RoHS and ELV compliant); and a proprietary sealer, this combination being referred to by JVI as their "Platinum J-Finish", the specifications of which are presented in Table 2. A galvanized member (bar, rod, or plate) 152 is welded to faceplates of the two vector connectors 150, the legs of which have been positioned in the uncured, precast concrete double-T members 102A, 102B. More details of vector connectors may be found in U.S. Pat. No. 6,185,897, assigned to JVI. Inc.

TABLE 2

"Platinum J-Finish" Specifications*

| | |
|---|---|
| Coating thickness | minimum 0.0005 inch on significant surface |
| Appearance | There shall be no evidence of blisters, peeling, pinholes, pits, or rough surface on parts |
| Adhesion Requirements | There shall be no defects such as peeling, blisters, or cracking after heating coated parts to 300 (+/−) 10° C. for 30 (+/−) 5 mins. and quenching in water at 15° C. to 25° C. |
| Corrosion Resistance ASTM B 117 | Part shall no evidence of white corrosion after 96-hour exposure.<br>Part shall no evidence of red rust after 500-hour exposure. |

*JVI, Inc., Lincolnshire, Illinois

Figure 17:
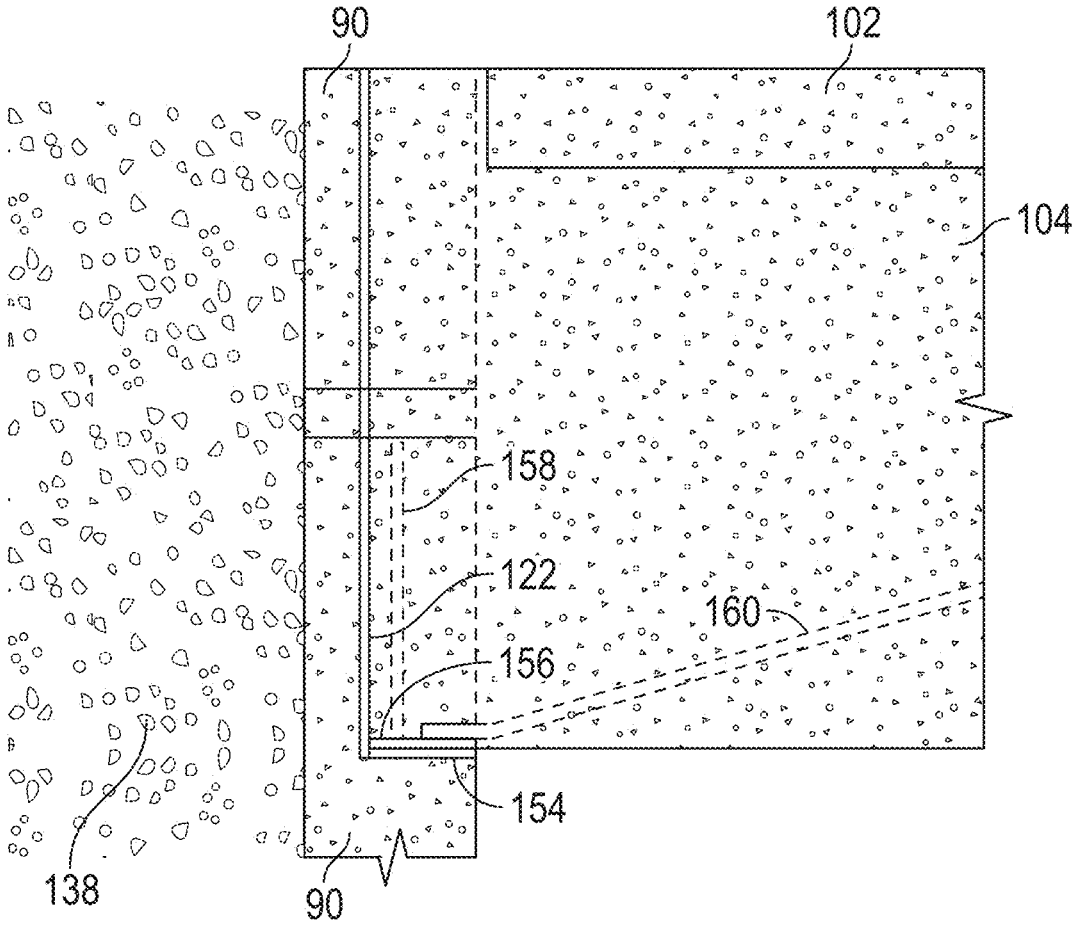
FIG. 17 is a more detailed schematic cross-sectional view, with some features in phantom, of a regular pocketed L-wall illustrated schematically in FIG. 151 and a web of a double-T member.
Figure 18:
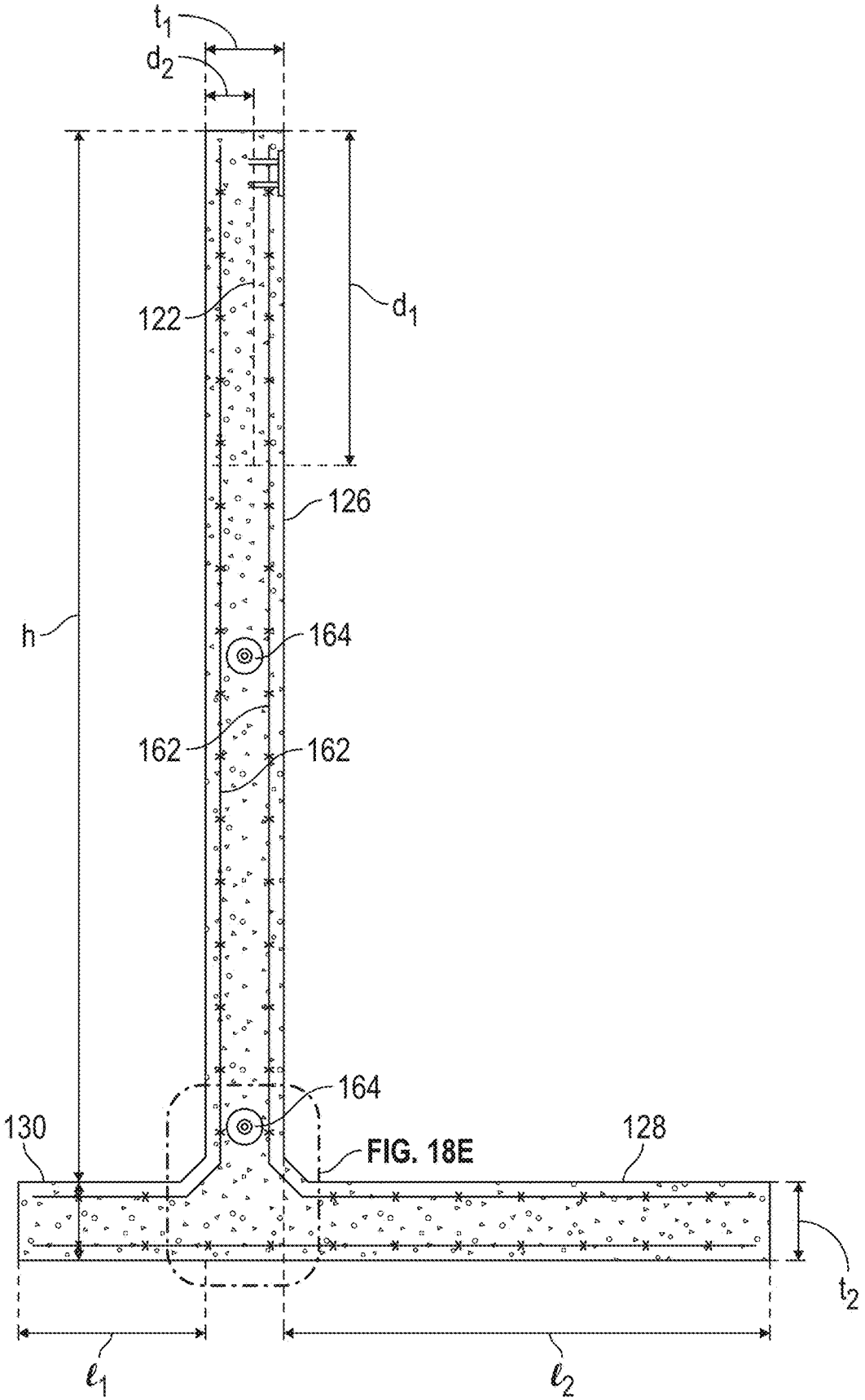
FIG. 18 is a detailed schematic cross-sectional view of a regular pocketed L-wall.
Figure 18A:
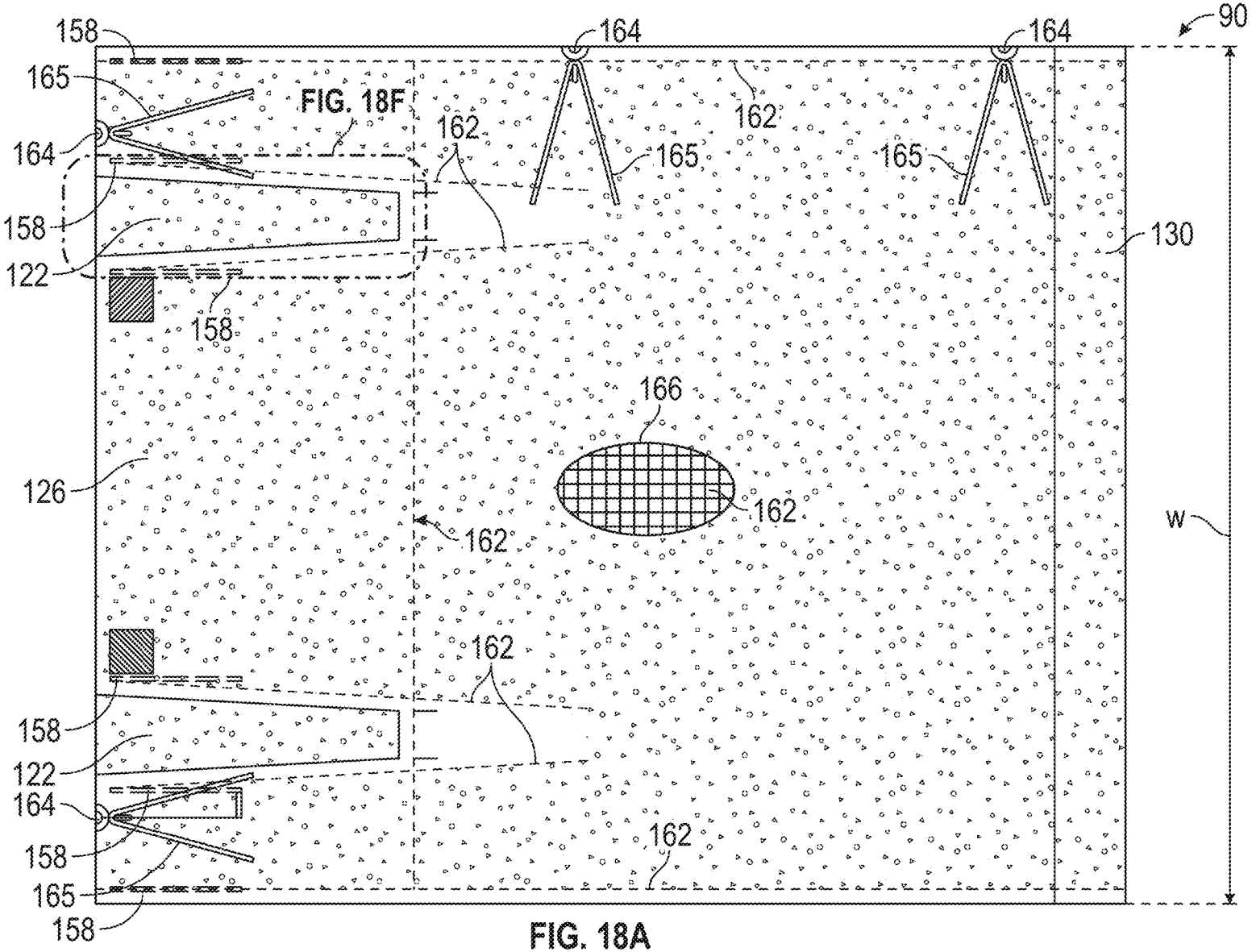
FIGS. 18A, 18B, 18C, 18D, 18E, and 18F illustrate schematically (with some features in phantom in FIGS. 18A, 18C, and 18F) some details of the regular pocketed L-wall illustrated schematically in FIG. 18, with FIGS. 18G and 18H illustrating schematically two steel bars ("rebar") useful in constructing bridge systems of the present disclosure.
Figure 18B:
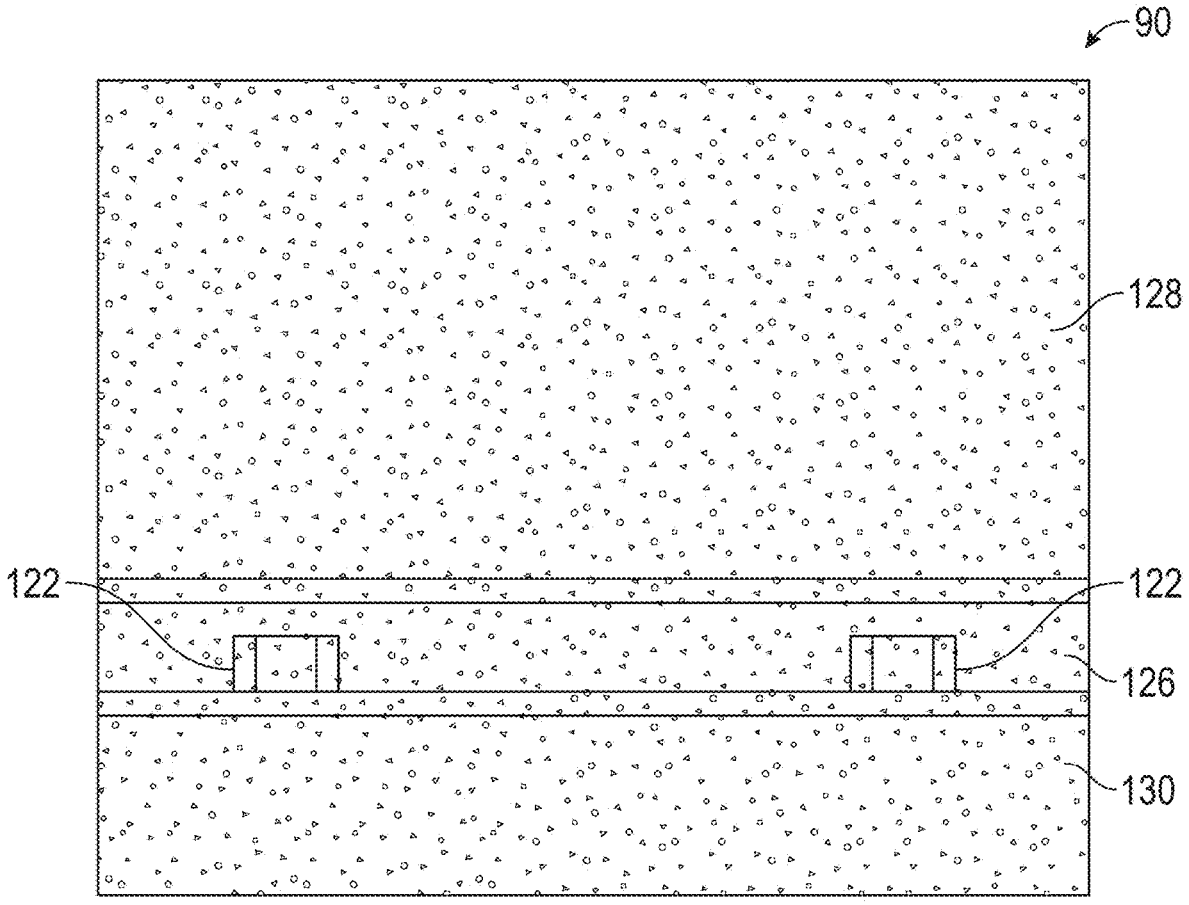
Figure 18C:
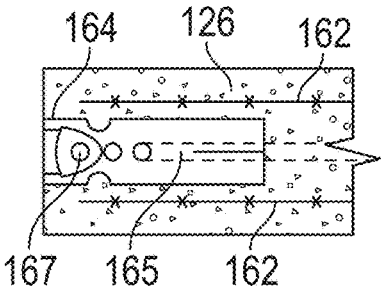
Figure 18D:
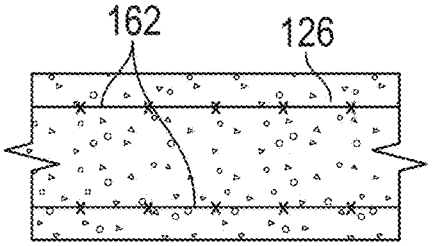
Figure 18E:
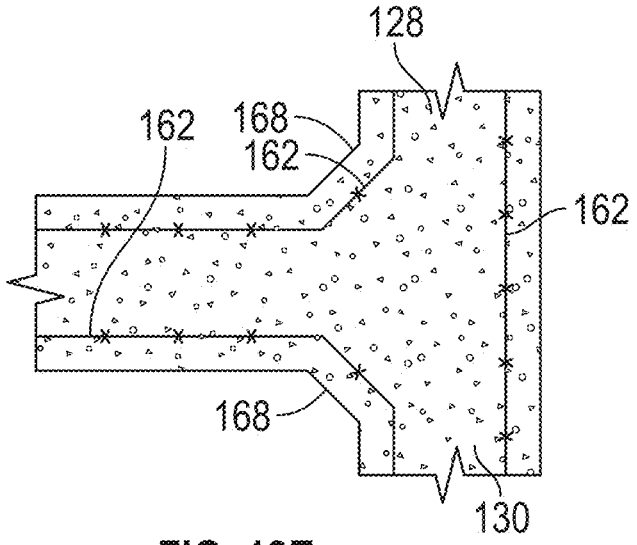
Figure 18F:
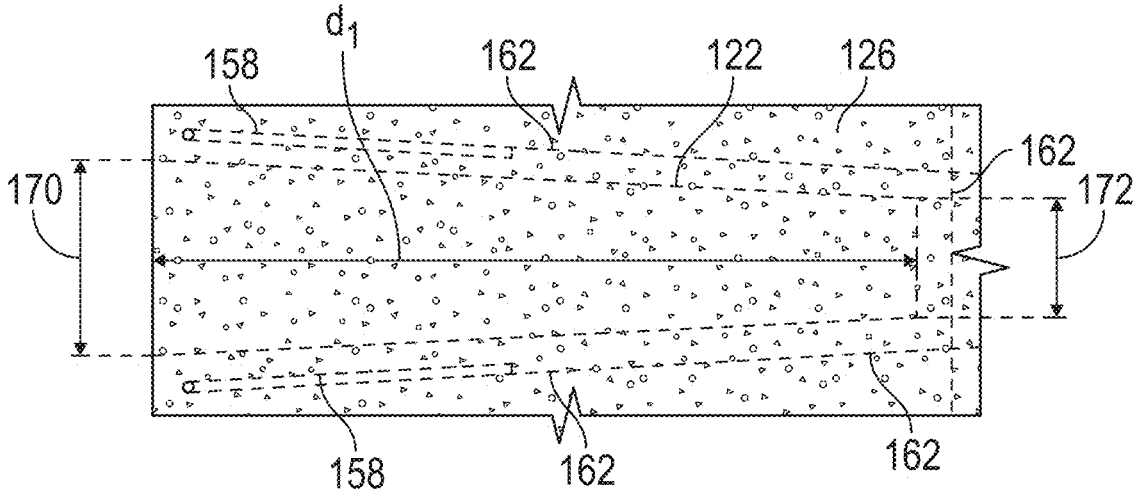
Figure 18G:
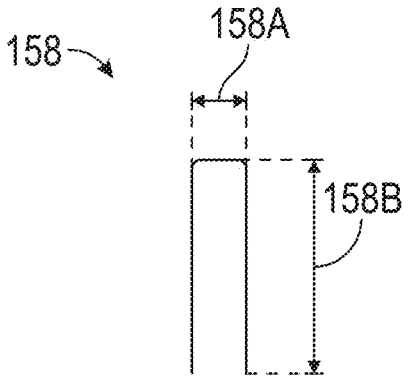
Figure 18H:
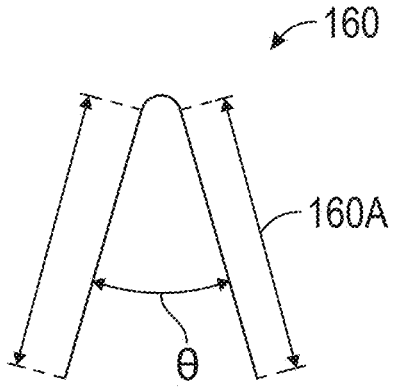

FIG. 17 is a more detailed schematic cross-sectional view, with some features in phantom, of regular pocketed L-wall 90 and web 104 of double-T member 102 illustrated schematically in FIG. 15I, illustrating schematically additional features, including a cotton duck fabric bearing pad 154, a galvanized steel plate 156, a vertical straight rebar 158 (details are provided in FIG. 18G, having a width 158A, and a length 158B), and a bent rebar 160 (details provided in FIG. 18H, having a length 160A, and an angle θ ranging from about 20 to about 40 degrees).

FIG. 18 is a detailed schematic cross-sectional view of regular pocketed L-wall 90, having a height "h" of stem of 90, a depth "d" of pocket 122, a length "$l_1$" of hindbase 130, and a length "$l_2$" of forebase 128. A welded wire mesh 162 is illustrated, as well as erection anchors 164 (for example, 8 ton RL-3 Burke 79589 with RL-31 Rapid Lift Shear Bar (item 165 in FIG. 18A), available from Meadow Burke LLC, a Leviat CRH company, Riverview, FL) Holes 167 in erection anchors 164 allow for shear bars 165. The erection anchor known under the trade designation RL-3 Rapid Lift Tech Erection Anchor is designed for safe edge lifting and rotation of thin-wall precast elements. The anchor is designed with two ears on the head of the anchor to restrict the rotation. As a result, lateral forces are transmitted directly to the anchor instead of to the concrete to prevent spalling. Due to the stress caused by the shear lift on the concrete; it is necessary to add reinforcement in the direction of the lift. The shear bars known under the trade designation RL-31 Rapid Lift Shear Bar are designed for this purpose. Anchor dimensions depend on the size of the anchor. The 8-ton version has a length of 12.5 inches, a width of 3.75 inches, and thickness of 0.75 inch; with ultimate mechanical load of about 64,000 lbs., and a weight of about 9 lbs. Other details are provided on the meadowburke.com website, such as safe working loads. The erection anchor known under the trade designation RL-3 Tech Erection Anchor is available in plain or hot dip galvanize finish.

FIGS. 18A, 18B, 18C, 18D, 18E, and 18F illustrate schematically (with some features in phantom in FIGS. 18A, 18C, and 18F) some details of the regular pocketed L-wall 90 illustrated schematically in FIG. 18, with FIGS. 18G and 18H illustrating schematically two steel bars ("rebar") useful in constructing bridge systems of the present disclosure. A cut-out portion 166 in FIG. 18A is illustrated, allowing view of welded wire mesh 162. Also illustrated in FIG. 18A is a width "w" of regular L-wall 90. It should be noted that irregular L-walls 92, 94, 96, and 98 will have basically the same construction as regular L-wall 90 but will include one angled side, as illustrated in FIG. 15. FIG. 18B illustrates a plan view of regular L-wall 90, with tapered pockets 122. With reference to FIG. 18F, where pocket 122 is illustrated schematically in phantom, note that pockets 122 have a major width 170 that is more than a minor width 172. Major width 170 may range from about 8 to about 14 inches, while minor width 172 may range from about 4 to about 10 inches, with the proviso that major width 170 is greater than minor width 172. FIG. 18D illustrates a portion of stem 126 of regular L-wall 90, illustrating welded wire mesh 162 positioned near the respective faces of stem 126. As an example, for a stem 126 having a width of 10 inches, welded wire mesh 162 may be positioned about 2 inches from each face. FIG. 18E illustrates in detail the joint between L-wall stem 126 and forebase 128 and hindbase 130, illustrating strengthening chamfers 168. As an example, for a stem width of 10 inches, chamfers 168 may be about 3 inches in length. Various broad and narrow ranges of dimensions for regular L-walls are provided in Table 3.

TABLE 3

Dimensions for L-Wall members

| L-wall Feature | Broad range (centimeters) | Less broad range (centimeters) |
|---|---|---|
| h | 50-2000 | 200-500 |
| pocket height, $d_1$ | 5-200 | 50-150 |
| pocket depth, $d_2$ | $0.5(t_1)$-$0.8(t_1)$ | $0.7(t_1)$-$0.8(t_1)$ |
| width, w | 50-300 | 50-100 |
| hindbase length, $l_1$ | 10-100 | 50-100 |
| forebase length, $l_2$ | 50-300 | 100-200 |
| stem thickness, $t_1$ | 20-30 | 22-27 |
| forebase thickness, $t_2$ | 20-30 | 22-27 |
| chamfer length, 168 | 2.5-13 | 5-10 |
| pocket major width, 170 | 20-36 | 25-30 |
| pocket minor width, 172 | 10-25 | 15-20 |
| straight rebar width, 158A | 8-23 | 13-18 |
| straight rebar length, 158B | 46-76 | 51-71 |
| bent rebar length, 160A | 76-107 | 81-101 |
| bent rebar angle, θ | 20-40 degrees | 25-35 degrees |

Figure 19:
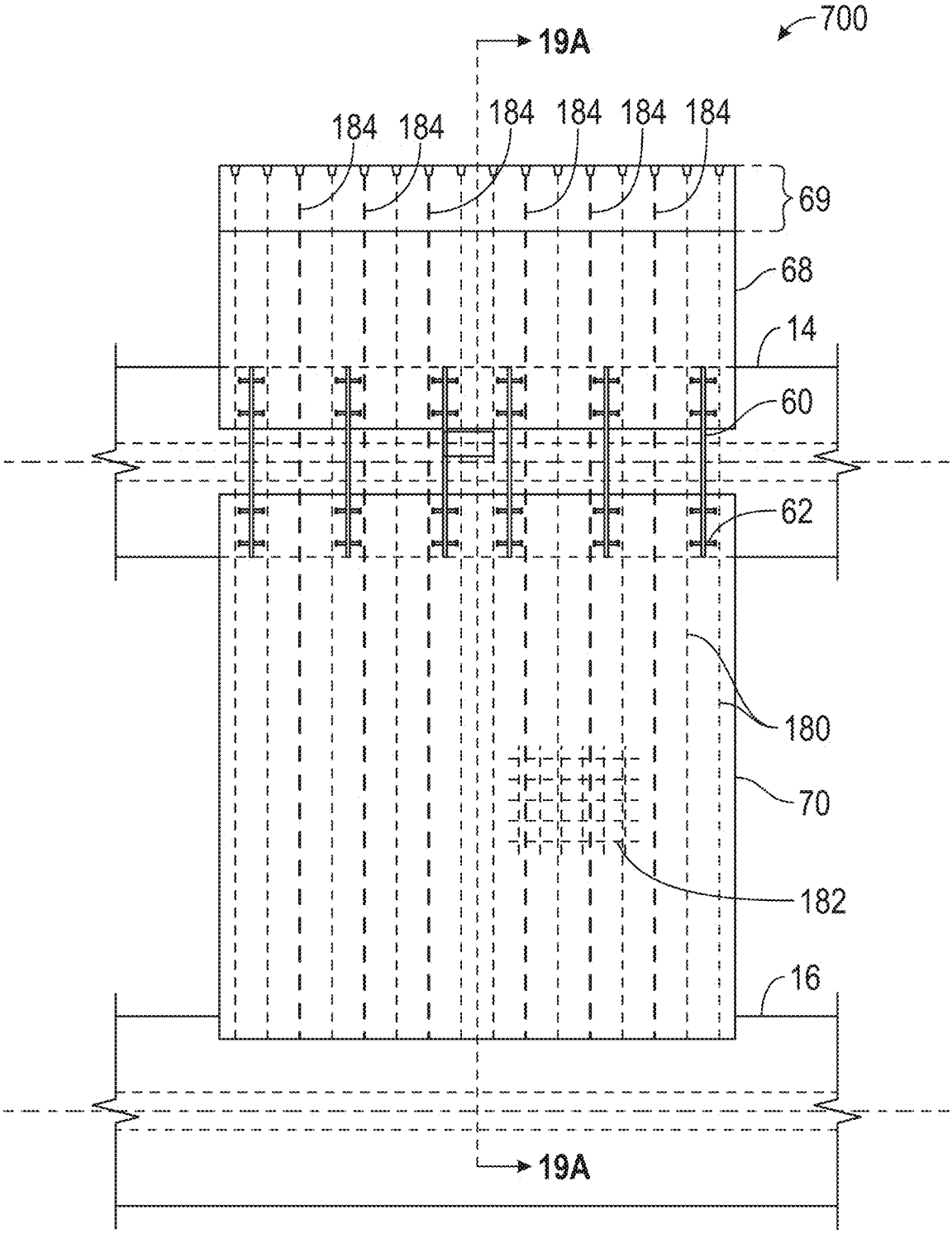
FIG. 19 is a schematic plan view, with some features in phantom, and FIG. 19A a schematic cross-sectional view taken along cross-section "19A-19A" in FIG. 19, of another bridge panel and system in accordance with the present disclosure, and FIG. 19B. is a perspective view of a bridging plate useful in the embodiment illustrated schematically in FIGS. 19 and 19A.
Figure 19A:
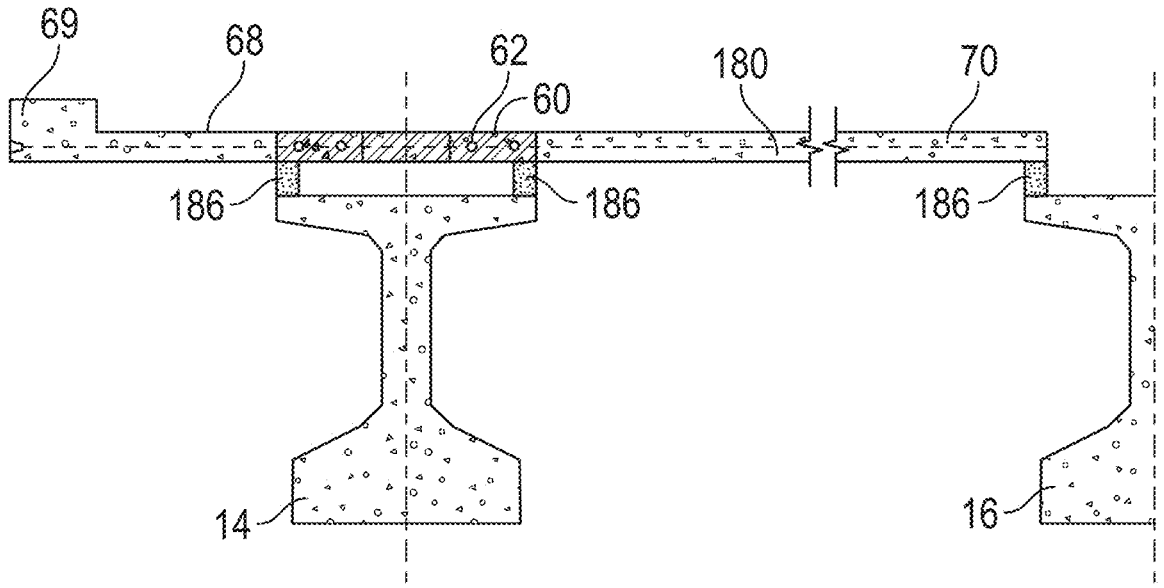
Figure 19B:
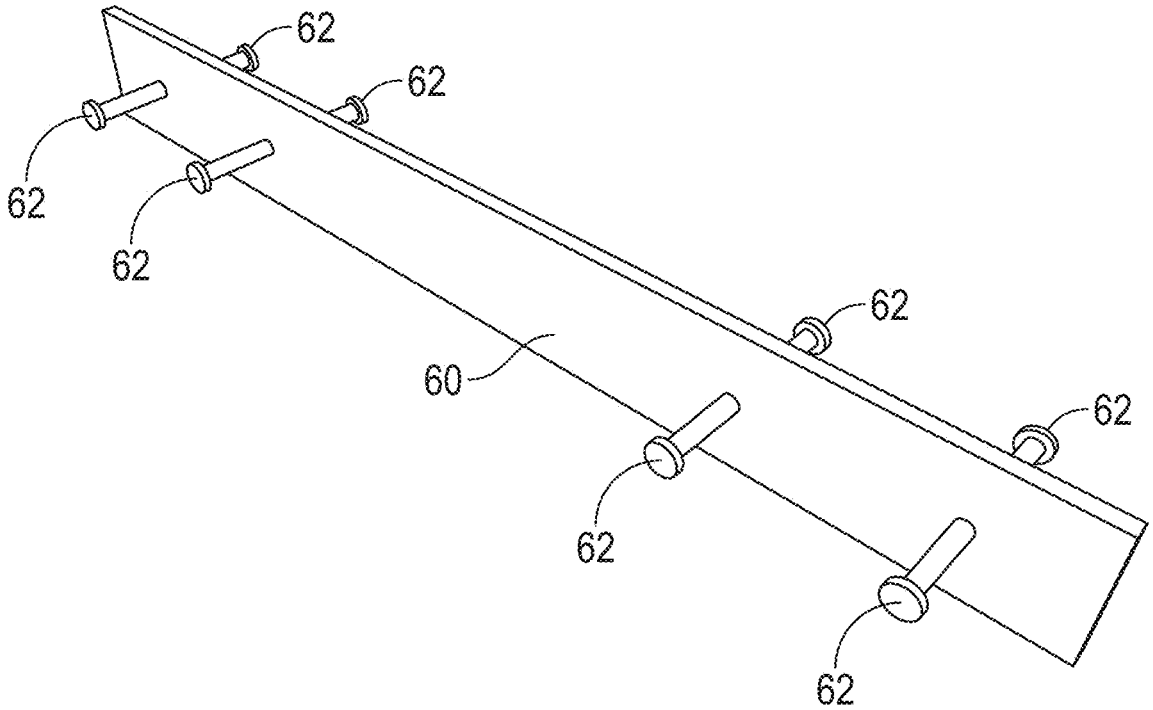

FIG. 19 is a schematic plan view, with some features in phantom, and FIG. 19A a schematic cross-sectional view taken along cross-section "19A-19A" in FIG. 19, of another bridge panel and system embodiment 700 in accordance with the present disclosure, and FIG. 19B is a perspective view of a bridging plate useful in embodiment 700 illustrated schematically in FIGS. 19 and 19A. Embodiment 700 is similar to embodiment 500, except that in embodiment 700, a plurality of prestressed concrete steel strands 180 (sometimes referred to as "PC strand") and bridging plates 60 remove the need for wide, thin bottom edges for a cast in place closure pour to connect the panels. One or more bridging plates 60 may be precast into precast overhang panels 68 and traffic panels 70, bridging plates 60 further secured therein with one or more studs 62 positioned on both sides of the bridging plates 60 by welding studs 62 to bridging plates 60 using a stud welding machine, as previously explained. In embodiment 700 the bridging plates 60 are spaced at 18 inches (about 46 cm) apart, but they could be spaced closer or further together. However, in embodiment 700, unlike embodiment 500, no holes or slots are provided in bridging plates 60 to accommodate transverse bars, nor are longitudinal bars or truss wires used to assist securing precast overhang panels 68 to the precast traffic panels 70. Rather, embodiment 700 employs the plurality of PC strands 180, for example 0.375 inch (9.53 mm) diameter PC strands placed at about 6 inches (about 15 cm) apart, and prestressed at, for example, 14 kips (about 62 kN). Some of the PC strands 184 are "debonded" (or "unbonded") in overhang panel 68, meaning that the PC strands are blanketed or wrapped for a short, limited distance with sheathing, preventing the strands from forming a bond with the concrete; this debonding of strands toward the end sections reduces end stresses by reducing the prestressing force in those sections. Of the total of 16 PC strands in overhang panel 68, 6 are illustrated as debonded. The number could be higher or lower, depending on how much stress relief is desired. Overhang panel 68 also includes a thickened panel edge 69, which may be from about 8 to about 16 inches wide (from about 20 to about 40 cm). Welded wire reinforcement 182 is also used, for example, 0.22 inch wire, 4 inch square. To complete the construction on-site, cast-in-place (CIP) concrete is poured over precast traffic panels 70 and precast overhang panels 68, as well as filling gaps between ends of precast traffic panels 70 and precast overhang panels 68 (not illustrated schematically in FIGS. 19 and 19A for clarity). Foam panel supports 186, rated for 40 psi (about 275 kPa) or more, are positioned between panels 68, 70, and girders 14, 16.

Different types of PC strand may be used, but they are typically specified according to the following parameters: structure (for example, 1×7, 1×2, 1×3, 1×19); strand diameter (from about 9 mm up to about 22 mm); relaxation, for example, no more than 2.5% @ 1000 hrs.; tensile strength, typically 1470 to 1960 MPa; yield strength, typically 1320 to 1760 MPa; elongation, not less than 3.5%; bonded or unbonded; materials, for example cold drawn carbon steel. PC strand is made and is typically tested in accordance with the following standards: ASTM A416 and ASTM A421 (USA); GB/T5224 (China); ISO6934; EN10138 (Europe), and the like.

In certain embodiments the panels, support members, L-walls, double-T members, and foundation slabs may be comprised of a suitable material or materials to withstand environmental conditions expected in the geographic region of installation. Such materials may be inert to human-hazardous vapors or gases, such as hydrogen sulfide ($H_2S$). Suitable materials include various ceramic materials, such as concrete, metals and alloys, natural and man-made rubber compounds, elastomeric compounds, thermoplastic-elastomeric compounds, and the like, with or without fillers, additives, coupling agents, and other optional additives. Panels, support members, L-walls, double-T members, and foundation slabs useful in the systems and methods of the present disclosure should have sufficient strength to withstand any mechanical stress (compression, tensile, shear) or other loads imposed by the items connected to them, and stresses imposed by geologic faults in the region of installation and loads imposed by expected traffic. This desire for sufficient strength is balanced by the need to maintain light-weight and balance. Panels, support members, L-walls, double-T members, and foundation slabs should be capable of withstanding long term exposure to probable liquids and vapors, including hydrocarbons, solvents, brine, anti-freeze compositions, and the like, typically encountered with bridges. In certain embodiments, panels, support members, L-walls, double-T members, and foundation slabs may be rendered corrosion-resistant, water-resistant, freeze-resistant, and/or heat-resistant. Such material properties may be supplied by one or more coatings.

In certain other embodiments, the panels, support members, L-walls, double-T members, and foundation slabs need not take the shapes as illustrated schematically in the drawings. For example, there are many versions of panels that may be required, and many different support members are commercially available. Furthermore, the bridge systems could take any shape, such as linear, curvilinear, or combination thereof and the like, and may take on one or more levels, as long as the bridge system is able to carry out its intended function. It will be understood that such embodiments are part of this disclosure and deemed with in the claims.

Panels, support members, L-walls, double-T members, and foundation slabs, and various components and coatings for same, may be made using a variety of additive and/or subtractive processes, including molding, machining, and like subtractive processes, and/or subtractive processes such as net-shape casting (or near-net shape casting) using rapid prototype (RP) molds. Net-shape or near-net shape casting methods of making a variety of molds for producing a variety of complex products are summarized in patents assigned to 3D Systems, Inc., Rock Hill, South Carolina, U.S.A., for example U.S. Pat. No. 8,285,411. As summarized in the '411 patent, a number of technologies presently exist for the rapid creation of models, prototypes, and objects for limited run manufacturing. These technologies are generally called Solid Freeform Fabrication ("SFF") techniques. Some SFF techniques include stereolithography, selective deposition modeling, laminated object manufacturing, selective phase area deposition, multi-phase jet solidification, ballistic particle manufacturing, fused deposition modeling, particle deposition, laser sintering, film transfer imaging, and the like. Generally, in SFF, complex parts are produced from a build material in an additive fashion as opposed to conventional fabrication techniques, which are generally subtractive in nature. For example, in most conventional subtractive fabrication techniques material is removed by machining operations or shaped in a die or mold to near net shape and then trimmed. In contrast, additive fabrication techniques incrementally add portions of a build material to targeted locations, layer by layer, in order to build a complex part. SFF technologies typically utilize a computer graphic representation of a part and a supply of a build material to fabricate the part in successive layers. According to the '411 patent, SFF technologies may dramatically shorten the time to develop prototype parts, can produce limited numbers of parts in rapid manufacturing methods, and may eliminate the need for complex tooling and machining associated with conventional subtractive manufacturing methods, including the need to create molds for custom applications. In addition, customized parts can be directly produced from computer graphic data (e.g., computer-aided design (CAD) files) in SFF techniques. Generally, in most techniques of SFF, structures are formed in a layer by layer manner by solidifying or curing successive layers of a build material. In selective laser sintering, a tightly focused beam of energy, such as a laser beam, is scanned across sequential layers of powder material to selectively sinter or melt powder (such as a metal or ceramic powder) in each layer to form a multilayered part. In selective deposition modeling, a build material is jetted or dropped in discrete droplets, or extruded through a nozzle, such that the build material becomes relatively rigid upon a change in temperature and/or exposure to actinic radiation in order to build up a three-dimensional part in a layerwise fashion. In another technique, film transfer imaging ("FTI"), a film transfers a thin coat of resin to an image plane area where portions of the resin corresponding to the cross-sectional layer of the part are selectively cured with actinic radiation to form one layer of a multilayer part. Certain SFF techniques require the part be suspended from a supporting surface such as a build pad, a platform, or the like using supports that join the part to the supporting surface. Prior art methods for generating supports are described in U.S. Pat. Nos. 5,595,703; 6,558,606; and 6,797,351. The Internet website of Quickparts.com, Inc., Atlanta, GA, a subsidiary of 3D Systems Inc., has more information on some of these techniques and materials that may be used.

Thus apparatus, systems, and methods described herein provide a consistent, low-cost, and safe way of constructing bridges, in particular those having overhang traffic portions employing one or more panels and support members, or those employing L-walls and double-T members, without workers having to work at great heights to construct the overhangs or other features Such methods are not only dangerous to workers, but are very expensive to construct. Systems and methods of the present disclosure avoid some or all these disadvantages of existing systems and methods.

Embodiments Disclosed Herein Include:

A. Apparatus comprising (or consisting essentially of, or consisting of):

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

c) the generally planar panel upper portion having same width W as the generally planar bottom panel portion, and having a length l that is less than the length L, while the generally planar bottom panel portion has a length L;

d) a concave cutout formed in the inner edge, the leading edge, and the trailing edge; and e) the generally rectangular, precast, prestressed concrete panel having at least one block out or void for placing wire mesh cages for closure pour of concrete to connect the generally rectangular, precast, prestressed concrete panel to a support.

B: A system comprising (or consisting essentially of, or consisting of):

a) a plurality of generally rectangular, precast, prestressed concrete panels, each of the generally rectangular, precast, prestressed concrete panels comprising:

i) a length L, a width W, a thickness t, a top surface, a bottom surface, a leading edge, a trailing edge, an inner edge, and an overhang edge;

ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

iii) the generally planar panel upper portion having same width W as the generally planar bottom panel portion, and having a length l that is less than the length L, while the generally planar bottom panel portion has a length L;

iv) a concave cutout formed in the inner edge, the leading edge, and the trailing edge; and v) at least one block out or void for placing wire mesh cages for closure pour of concrete to connect the generally rectangular, precast, prestressed concrete panel to a support; and b) at least one support beam attached to the plurality of generally rectangular, precast, prestressed concrete panels by a combination of wire and poured, solidified concrete.

C: A method of installing a bridge system, the method comprising (or consisting essentially of, or consisting of):

a) delivering a plurality of generally rectangular, precast, prestressed concrete panels to an installation site, each of the generally rectangular, precast, prestressed concrete panels having:

i) a length L, a width W, a thickness t, a top surface, a bottom surface, a leading edge, a trailing edge, an inner edge, and an overhang edge;

ii) a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

iii) the generally planar panel upper portion having same width W as the generally planar bottom panel portion, and having a length l that is less than the length L, while the generally planar bottom panel portion has a length L;

iv) a concave cutout formed in the inner edge, the leading edge, and the trailing edge; and v) at least one block out or void for placing wire mesh cages for closure pour of concrete to connect the generally rectangular, precast, prestressed concrete panel to a support;

b) delivering one or more support beams to the installation site, each support beam having a support and a base;

c) positioning the plurality of generally rectangular, precast, prestressed concrete panels on the supports of the one or more support beams with an overhang panel section and a traffic panel section;

d) optionally backfilling over the bases of the at least one support beams; and e) connecting the generally rectangular, precast, prestressed concrete panels to the support beams by positioning wire mesh cages in the at least one block out or void, pouring unsolidified concrete into the at least one block out or void, and curing the unsolidified concrete to form an overhang traffic surface.

D: Apparatus comprising (or consisting essentially of, or consisting of):

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having at least one bridging plate cast into the generally rectangular, precast, prestressed concrete panel and further secured therein by one or more studs;

c) the generally rectangular, precast, prestressed concrete panel having one or more block outs or voids for closure pour of cast-in-place concrete to connect the generally rectangular, precast, prestressed concrete panel to a support, the cast-in-place concrete positioned around a central section of each of the one or more bridging plates.

E: A system comprising (or consisting essentially of, or consisting of):

a) a plurality of generally rectangular, precast, prestressed concrete panels, each of the generally rectangular, precast, prestressed concrete panels comprising:

i) a length L, a width W, a thickness t, a top surface, a bottom surface, a leading edge, a trailing edge, an inner edge, and an overhang edge;

ii) the generally rectangular, precast, prestressed concrete panel having at least one bridging plate cast into the generally rectangular, precast, prestressed concrete panel and further secured therein by one or more studs;

iii) the generally rectangular, precast, prestressed concrete panel having one or more block outs or voids for closure pour of cast-in-place concrete to connect the generally rectangular, precast, prestressed concrete panel to a support, the cast-in-place concrete positioned around a central section of each of the one or more bridging plates; and b) at least one support beam attached to the plurality of generally rectangular, precast, prestressed concrete panels by a combination of wire and poured, solidified concrete.

F: A method of installing a bridge system, the method comprising (or consisting essentially of, or consisting of):

a) delivering a plurality of generally rectangular, precast, prestressed concrete panels to an installation site, each of the generally rectangular, precast, prestressed concrete panels having:

i) a length L, a width W, a thickness t, a top surface, a bottom surface, a leading edge, a trailing edge, an inner edge, and an overhang edge;

ii) the generally rectangular, precast, prestressed concrete panel having at least one bridging plate cast into the generally rectangular, precast, prestressed concrete panel and further secured therein by one or more studs;

iii) the generally rectangular, precast, prestressed concrete panel having one or more block outs or voids for closure pour of cast-in-place concrete to connect the generally rectangular, precast, prestressed concrete panel to a support, the cast-in-place concrete positioned around a central section of each of the one or more bridging plates;

b) delivering one or more support beams to the installation site, each support beam having a support and a base;

c) positioning the plurality of generally rectangular, precast, prestressed concrete panels on the supports of the one or more support beams with an overhang panel section and a traffic panel section;

d) optionally backfilling over the bases of the at least one support beams; and e) connecting the generally rectangular, precast, prestressed concrete panels to the support beams by positioning the at least one block out or void over the support beams, pouring unsolidified concrete into the at least one block out or void and around a central section of each bridging plate, and curing the unsolidified concrete to form an overhang traffic surface.

Each of the embodiments A, B, C, D, E, and F may have one or more of the following additional elements in any combination:

Element 1: a traffic panel section extending from the leading edge to the trailing edge, and from the inner edge to a line parallel with the inner edge, and an overhang panel section, the overhang section extending from the line parallel with the inner edge to the overhang edge.

Element 2: the traffic panel section is a major portion of the generally rectangular, precast, prestressed concrete panel.

Element 3: the at least one block out or void has a plan shape selected from octagonal, pentagonal, hexagonal, rectangular, round, elliptical, triangular, and trapezoidal.

Element 4: the at least one block out or void has an upper void length, an upper void width, a bottom void length, and a bottom void width, and wherein the upper void length is greater than the bottom void length, and wherein the upper void width is greater than the bottom void width.

Element 5: the line parallel with the inner edge bisects the at least one block out or void for placing wire mesh cages for closure pour of concrete.

Element 6: at least one anchor to bolt steel plate forms to the overhang edge of the generally rectangular, precast, prestressed concrete panel.

Element 7: an angle $\alpha$ equal to a radius angle of a horizontal roadway, wherein angle $\alpha$ ranges from about 1 to about 10 degrees.

Element 8: the angle $\alpha$ ranges from about 1 to about 5 degrees.

Element 9: one of the at least one support beams is attached through the at least one block out or void by the combination of wire and poured, solidified concrete.

Element 10: the at least one support beam is a prestressed concrete girder.

Element 11: the prestressed concrete girder comprises one or more vertical U-shaped steel wire reinforcements having a U-portion and two leg portions, wherein the U-portion extends into the poured, solidified concrete.

Element 12: each of the generally rectangular, precast, prestressed concrete panels comprises a traffic panel section extending from the leading edge to the trailing edge, and from the inner edge to a line parallel with the inner edge, and an overhang panel section, the overhang section extending from the line parallel with the inner edge to the overhang edge.

Element: 13: the traffic panel section is a major portion of the generally rectangular, precast, prestressed concrete panels.

Element 14: the at least one block out or void has a plan shape selected from octagonal, pentagonal, hexagonal, rectangular, round, elliptical, triangular, and trapezoidal.

Element 15: the line parallel with the inner edge bisects the at least one block out or void for placing wire mesh cages for closure pour of concrete.

Element 16: methods wherein the delivering a plurality of generally rectangular, precast, prestressed concrete panels to an installation site comprises delivering a left side plurality of generally rectangular, precast, prestressed concrete panels and a right side plurality of generally rectangular, precast, prestressed concrete panels to an installation site;

wherein the delivering of one or more support beams to the installation site comprises delivering a left outside prestressed concrete girder support and a right outside prestressed concrete girder support and one inside prestressed concrete girder support to the installation site;

positioning inside edges of the left and right side pluralities of generally rectangular, precast, prestressed concrete panels on the inside prestressed concrete girder support such that there is formed a gap between the inside edges;

positioning overhang edges of the left and right side pluralities of generally rectangular, precast, prestressed concrete panels on the left outside and right outside prestressed concrete girder supports, respectively, so as to provide a left overhang section and a right overhang section;

connecting the left and right pluralities of generally rectangular, precast, prestressed concrete panels to the inside prestressed concrete girder support by positioning steel wire reinforcing cages in the gaps, pouring unsolidified concrete into the gaps, and curing the unsolidified concrete; and connecting the left and right pluralities of generally rectangular, precast, prestressed concrete panels to the left and right prestressed concrete girder supports by positioning steel wire reinforcing cages in the at least one block out or void in each of the left and right pluralities of generally rectangular, precast, prestressed concrete panels, pouring unsolidified concrete into the at least one block out or void, and curing the unsolidified concrete.

G: A bridge system comprising (or consisting essentially of, or consisting of):

a) one or more load-bearing, regular precast pocketed L-walls, each having a stem, a forebase, and a hindbase, with two pockets in the stem in a hindbase side of the stem;

b) a load-bearing, right-sided irregular precast pocketed L-wall, each having a stem, a forebase, and a hindbase, with two pockets in the stem in a hindbase side of the stem;

c) a non-load-bearing, right-sided irregular precast non-pocketed L-wall;

d) a non-load-bearing, left-sided irregular precast L-wall;

e) load-bearing, left-sided irregular precast L-wall, each having a stem, a forebase, and a hindbase, with two pockets in the stem in a hindbase side of the stem;

f) a plurality of double-T members arranged and fastened together in at least two adjacent rows, with an equal number of double-T members in each row, each double-T member having a pair of webs, a span, and two flanges, and forming a plurality of webs, each of the plurality of webs having a proximal end and a distal end resting in one of the pockets;

g) the one or more load-bearing, regular precast pocketed L-walls being proximate a middle of the bridge system;

h) the load-bearing right-sided irregular precast pocketed L-wall having one edge positioned adjacent and fastened to a mating edge of the non-load-bearing left-sided irregular precast L-wall;

i) the non-load-bearing right-sided irregular precast L-wall having one edge positioned adjacent and fastened to a mating edge of the load-bearing left-sided irregular precast pocketed L-wall; and j) the one or more load-bearing regular precast pocketed L-walls forming first and second edges, the first edge positioned adjacent and fastened to a mating edge of the load-bearing left-sided irregular precast pocketed L-wall, and the second edge positioned adjacent and fastened to a mating edge of the load-bearing right-sided irregular precast pocketed L-wall.

H: A method of installing a bridge system, the method comprising:

a) delivering a plurality of precast, prestressed concrete double-T members to an installation site, each of the precast, prestressed concrete double-T members comprising each double-T member having a pair of webs, a span, and two flanges, and forming a plurality of webs, each of the plurality of webs having a proximal end and a distal end:

b) delivering a plurality of precast foundation slabs to the installation site;

c) delivering to the installation site:

i) one or more load-bearing, regular precast pocketed L-walls, each having a stem, a forebase, and a hindbase, with two pockets in the stem in a hindbase side of the stem;

ii) a load-bearing, right-sided irregular precast pocketed L-wall having a stem, a forebase, and a hindbase, with two pockets in the stem in a hindbase side of the stem;

iii) a non-load-bearing, right-sided irregular precast non-pocketed L-wall; iv) a non-load-bearing, left-sided irregular precast L-wall; and v) a load-bearing, left-sided irregular precast L-wall having a stem, a forebase, and a hindbase, with two pockets in the stem in a hindbase side of the stem;

d) positioning components (i), (ii), (iii), (iv), and (v) on the plurality of precast foundation slabs;

e) backfilling over bases of components (i), (ii), (iii), (iv), and (v);

f) positioning each of the plurality of precast, prestressed concrete double-T members adjacent at least one other of the plurality of precast, prestressed concrete double-T members, where the proximal ends and the distal ends of the plurality of webs of the plurality of precast, prestressed concrete double-T members are positioned in respective pockets; and g) connecting each of the plurality of precast, prestressed concrete double-T members to at least one adjacent one of the plurality of precast, prestressed concrete double-T members.

Each of the embodiments F and G may have one or more of the following additional elements in any combination:

Element 17: the bridge system comprises a single load-bearing, regular precast pocketed L-wall.

Element 18: the load-bearing right-sided irregular precast pocketed L-wall having one edge positioned adjacent and fastened to a mating edge of the non-load-bearing left-sided irregular precast L-wall at an angle β, and the non-load-bearing right-sided irregular precast L-wall having one edge positioned adjacent and fastened to a mating edge of the load-bearing left-sided irregular precast pocketed L-wall at the angle β, where the angle β ranges from about 20 to about 40 degrees.

Element 19: the bridge system comprises precast foundation slabs positioned under each of components (a), (b), (c), (d), and (e).

Element: 20: The bridge system comprises one or more auger piles securing the precast foundation slabs to soil under each of the precast foundation slabs.

Element 21: The bridge system is devoid of auger piles.

I. Apparatus comprising (or consisting essentially of, or consisting of):

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having at least one bridging plate cast into the generally rectangular, precast, prestressed concrete panel and further secured therein by one or more studs;

c) the generally rectangular, precast, prestressed concrete panel having a plurality of prestressed strands cast therein running generally parallel to the length of the panel, and welded wire reinforcement through substantially all of its length and width.

J: A system comprising (or consisting essentially of, or consisting of):

a) a plurality of generally rectangular, precast, prestressed concrete panels, each of the generally rectangular, precast, prestressed concrete panels comprising:

i) a length L, a width W, a thickness t, a top surface, a bottom surface, a leading edge, a trailing edge, an inner edge, and an overhang edge;

ii) the generally rectangular, precast, prestressed concrete panel having at least one bridging plate cast into the generally rectangular, precast, prestressed concrete panel and further secured therein by one or more studs;

iii) the generally rectangular, precast, prestressed concrete panel having a plurality of prestressed strands cast therein running generally parallel to the length of the panel, and welded wire reinforcement through substantially all of its length and width;

b) a plurality of generally rectangular, precast, prestressed concrete overhang panels, each of the generally rectangular, precast, prestressed concrete overhang panels comprising portions of the prestressed strands, with a minor percentage of the portion of the precast strands being unbonded; and c) a support beam attached to the plurality of generally rectangular, precast, prestressed concrete panels at positions where the overhang edge and the overhang panels rest on the support beam by a combination of poured, cast-in-place solidified concrete and the prestressed strands.

K: A method of installing a bridge system, the method comprising (or consisting essentially of, or consisting of):

a) delivering a plurality of generally rectangular, precast, prestressed concrete panels and overhang panels as described in embodiment J to an installation site;

b) delivering one or more support beams to the installation site, each support beam having a support and a base;

c) positioning the plurality of generally rectangular, precast, prestressed concrete panels and overhang panels on the supports of the one or more support beams with an overhang panel section and a traffic panel section;

d) optionally backfilling over the bases of the at least one support beams; and e) connecting the generally rectangular, precast, prestressed concrete panels and overhang panels to the support beams by pouring unsolidified concrete into voids around a central section of each bridging plate and around the prestressed strands, and curing the unsolidified concrete to form an overhang traffic surface.

From the foregoing detailed description of specific embodiments, it should be apparent that patentable apparatus, systems, and methods have been described. Although specific embodiments of the disclosure have been described herein in some detail, this has been done solely for the purposes of describing various features and aspects of the systems and methods and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take an existing bridge and modify it to remove existing features and install features described herein in accordance with the present disclosure. Another modification would be to supply the bridge panels with coatings or topping materials, for example suitable for urban use. In other embodiments, the bridge panels, L-walls, double-Ts, and foundation slabs may be mountable on trucks or other vehicles drivable by humans, or on self-driving trucks or autos.

What is claimed is:

1. An apparatus comprising:

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having a generally planar panel upper portion and a generally planar panel bottom portion substantially parallel to the generally planar panel upper portion, the generally planar panel upper portion and the generally planar bottom panel portion sandwiching a generally planar central panel portion that has a length less than 1, and a width that is less than W;

c) the generally planar panel upper portion having same width W as the generally planar bottom panel portion, and having a length 1 that is less than the length L, while the generally planar bottom panel portion has a length L;

d) a concave cutout formed in the inner edge, the leading edge, and the trailing edge; and e) the generally rectangular, precast, prestressed concrete panel having at least one block out or void for placing wire mesh cages for closure pour of concrete to connect the generally rectangular, precast, prestressed concrete panel to a support.

2. The apparatus of claim 1 comprising a traffic panel section extending from the leading edge to the trailing edge, and from the inner edge to a line parallel with the inner edge, and an overhang panel section, the overhang section extending from the line parallel with the inner edge to the overhang edge.

3. The apparatus of claim 1 comprising at least one anchor to bolt steel plate forms to the overhang edge of the generally rectangular, precast, prestressed concrete panel.

4. A bridge system comprising:

a) a plurality of the apparatus of claim 1;

b) at least one support beam attached to the plurality of the apparatus of claim 1 by a combination of wire and poured, solidified concrete.

5. The bridge system of claim 4 wherein one of the at least one support beams is attached through the at least one block out or void by the combination of wire and poured, solidified concrete.

6. The bridge system of claim 4 wherein each of the generally rectangular, precast, prestressed concrete panels comprises a traffic panel section extending from the leading edge to the trailing edge, and from the inner edge to a line parallel with the inner edge, and an overhang panel section, the overhang section extending from the line parallel with the inner edge to the overhang edge.

7. A bridge system comprising:

a) one or more load-bearing, regular precast pocketed L-walls, each having a stem, a forebase, and a hindbase, with two pockets in the stem in a hindbase side of the stem;

b) a load-bearing, right-sided irregular precast pocketed L-wall, having a stem, a forebase, and a hindbase, with two pockets in the stem in a hindbase side of the stem;

c) a non-load-bearing, right-sided irregular precast non-pocketed L-wall;

d) a non-load-bearing, left-sided irregular precast non-pocketed L-wall;

e) a load-bearing, left-sided irregular precast pocketed L-wall, having a stem, a forebase, and a hindbase, with two pockets in the stem in a hindbase side of the stem;

f) a plurality of double-T members arranged and fastened together in at least two adjacent rows, with an equal number of double-T members in each row, each double-T member having a pair of webs, a span, and two flanges, and forming a plurality of webs, each of the plurality of webs having a proximal end and a distal end resting in one of the pockets;

g) the one or more load-bearing, regular precast pocketed L-walls being proximate a middle of the bridge system;

h) the load-bearing right-sided irregular precast pocketed L-wall having one edge positioned adjacent and fastened to a mating edge of the non-load-bearing left-sided irregular precast L-wall;

i) the non-load-bearing right-sided irregular precast L-wall having one edge positioned adjacent and fastened to a mating edge of the load-bearing left-sided irregular precast pocketed L-wall; and j) the one or more load-bearing regular precast pocketed L-walls forming first and second edges, the first edge positioned adjacent and fastened to a mating edge of the load-bearing left-sided irregular precast pocketed L-wall, and the second edge positioned adjacent and fastened to a mating edge of the load-bearing right-sided irregular precast pocketed L-wall.

8. The bridge system of claim 7 comprising a single load-bearing, regular precast pocketed L-wall.

9. The bridge system of claim 8 comprising the load-bearing right-sided irregular precast pocketed L-wall having one edge positioned adjacent and fastened to a mating edge of the non-load-bearing left-sided irregular precast L-wall at an angle β, and the non-load-bearing right-sided irregular precast L-wall having one edge positioned adjacent and fastened to a mating edge of the load-bearing left-sided irregular precast pocketed L-wall at the angle β, where the angle β ranges from about 20 to about 40 degrees.

10. The bridge system of claim 8 comprising precast foundation slabs positioned under each of components (a), (b), (c), (d), and (e).

11. The bridge system of claim 10 comprising one or more auger piles securing the precast foundation slabs to soil under each of the precast foundation slabs.

12. An apparatus comprising:

a) a generally rectangular, precast, prestressed concrete panel having a length L, a width W, a thickness t, a top surface, a bottom surface, a leading edge, a trailing edge, an inner edge, and an overhang edge;

b) the generally rectangular, precast, prestressed concrete panel having at least one bridging plate cast into the generally rectangular, precast, prestressed concrete panel and further secured therein by one or more studs, the bridging plates positioned generally parallel to the length L and devoid of holes or slots to accommodate transverse bars, the one or more studs extending generally parallel to the width W;

c) the generally rectangular, precast, prestressed concrete panel having a plurality of prestressed strands cast therein running generally parallel to the length of the panel, and welded wire reinforcement through substantially all of its length and width.

13. A bridge system comprising:

a) a plurality of the apparatus of claim 12;

b) a plurality of generally rectangular, precast, prestressed concrete overhang panels, each of the generally rectangular, precast, prestressed concrete overhang panels comprising portions of the prestressed strands, with a minor percentage of the portion of the precast strands being unbonded;

c) the plurality of the apparatus of claim 12 and the plurality of generally rectangular, precast, prestressed concrete overhang panels attached to a support beam at positions where the overhang edge and the overhang panels rest on the support beam, the attachment accomplished by a combination of poured, cast-in-place solidified concrete and the prestressed strands; and d) the system devoid of longitudinal bars or truss wires to assist securing the plurality of generally rectangular, precast, prestressed concrete overhang panels to the apparatus of claim 12.

* * * * *